US006908299B2

(12) United States Patent
Asano et al.

(10) Patent No.: US 6,908,299 B2
(45) Date of Patent: Jun. 21, 2005

(54) COMBUSTION APPARATUS

(75) Inventors: Kimiaki Asano, Kobe (JP); Hitoshi Hara, Kobe (JP); Tetsurou Hamada, Kobe (JP); Yoshinori Kanda, Kobe (JP); Hiroki Hasegawa, Kobe (JP); Toshihiro Hori, Kobe (JP)

(73) Assignee: Noritz Corporation, Hyogo (JP)

( * ) Notice: Subject to any disclaimer, the term of this patent is extended or adjusted under 35 U.S.C. 154(b) by 0 days.

(21) Appl. No.: 10/650,660

(22) Filed: Aug. 28, 2003

(65) Prior Publication Data

US 2004/0043342 A1 Mar. 4, 2004

(30) Foreign Application Priority Data

Aug. 29, 2002 (JP) ..... 2002-250546
Feb. 25, 2003 (JP) ..... 2002-046859

(51) Int. Cl.[7] ..... F23N 5/00
(52) U.S. Cl. ..... 431/12; 431/72
(58) Field of Search ..... 431/12, 72, 73, 431/18

(56) References Cited

U.S. PATENT DOCUMENTS

| | | | | |
|---|---|---|---|---|
| 6,024,064 A | * | 2/2000 | Kato et al. | 123/179.17 |
| 6,209,522 B1 | * | 4/2001 | Onishi et al. | 123/458 |
| 6,402,505 B1 | * | 6/2002 | Okada et al. | 431/18 |
| 6,581,573 B2 | * | 6/2003 | Nimura et al. | 123/496 |

FOREIGN PATENT DOCUMENTS

| | | |
|---|---|---|
| JP | 58-140508 | 8/1983 |
| JP | 60-022069 | 2/1985 |
| JP | 62-186112 | 8/1987 |
| JP | 63-275870 | 11/1988 |
| JP | 63-275870 (3-59310) | 11/1988 |
| JP | 01-167508 | 7/1989 |
| JP | 02-057816 | 2/1990 |
| JP | 03-063413 | 3/1991 |
| JP | 03-125814 | 5/1991 |
| JP | 03-221718 | 9/1991 |
| JP | 05-322153 | 12/1993 |
| JP | 07-098113 | 4/1995 |
| JP | 07-127843 | 5/1995 |
| JP | 07-269859 | 10/1995 |
| JP | 07-369863 | 10/1995 |
| JP | 07-324728 | 12/1995 |
| JP | 08-049839 | 2/1996 |
| JP | 08-075141 | 3/1996 |
| JP | 09-049628 | 2/1997 |
| JP | 09/268960 | 10/1997 |
| JP | 10-019156 | 1/1998 |
| JP | 10-205383 | 8/1998 |
| JP | 10-227453 | 8/1998 |
| JP | 11-241808 | 9/1999 |
| JP | 2000-018571 | 1/2000 |
| JP | 2000-074365 | 3/2000 |
| JP | 2000-161609 | 6/2000 |
| JP | 2000-249336 | 9/2000 |
| JP | 2000-304355 | 11/2000 |
| JP | 2001-065813 | 3/2001 |
| JP | 2001-140765 | 5/2001 |

* cited by examiner

*Primary Examiner*—Alfred Basichas
(74) *Attorney, Agent, or Firm*—Wood, Phillips, Katz, Clark & Mortimer

(57) ABSTRACT

A combustion apparatus 2 has a fuel spraying nozzle 12, a feed canal 16 and a return canal 17, both the canals connected to the nozzle, with the former canal 16 feeding a fuel to the nozzle and with the latter canal 17 allowing an unsprayed portion of the fuel to flow back. An electromagnetic pump 18 disposed in the feed canal 16 serves to compress the fuel towards the nozzle 12, and an injector valve 25 is disposed in the return canal 17. A controller 40 regulates the operation of the injector valve 25 in the manner of duty-ratio control so as to adjust the flow rate of the fuel being sprayed out of the nozzle 12.

20 Claims, 19 Drawing Sheets

COMBUSTION APPARATUS

BACKGROUND OF THE INVENTION

1. Field of the Invention

The present invention relates to a combustion apparatus for burning a liquid fuel.

2. Description of Related Art

Some combustion apparatuses known in the art are of the type as disclosed in Patent Laying-Open Gazette No. 10-227453. A fuel spraying nozzle incorporated in this apparatus operates to blow a fuel mist to be burnt continuously. This nozzle is of the so-called return type that has an internal return path such that a portion of the fuel supplied from a fuel tank will flow back toward the tank through the internal return path and a return channel provided out of the nozzle.

FIG. 18 is a flow diagram showing the flow of fuel in the related art combustion apparatus that includes the return type nozzle. A fuel spraying nozzle 205 built in this apparatus 201 has a spray mouth for jetting a fuel mist. A fuel channel (or "a fuel canal") 209 connected to the nozzle 205 is composed of a feed channel (or "a feed canal") 210 reaching the spray mouth and a return channel (or "a return canal") 211 leading back therefrom to an upstream region of said channel. The feed channel 210 starting from a fuel tank 214 so as to terminate at an inlet of the spraying nozzle 205 does include electromagnetic valves 212 and 213 and an electromagnetic pump 215 that are arranged in series along the feed channel. On the other hand, the return channel 211 connected to a returning side of the nozzle 205 does include a check valve 216 and a proportional control valve 217, that are likewise arranged in series. A downstream end of the return channel 211 merges into the feed channel 210, at a junction intervening between the electromagnetic valve 212 and the electromagnetic pump 215.

The proportional control valve 217 disposed in the return channel 211 is the so-called "ball type" valve that cannot absolutely close this channel 211. Therefore, the one electromagnetic valve 212 is interposed between the junction and the fuel tank 214 so as to avoid any excessive or undesired flow of fuel from or towards this tank.

FIG. 19 shows the structure of proportional control valve 217 employed in the related art combustion apparatus 201. This valve has an internal fuel passage 221 formed in a casing 220 and extending between a fuel inlet end 222 and a fuel outlet end 223, with the inlet end 222 leading to the check valve 216. A valve seat 225 is formed at an intermediate point in the internal passage 221, and a spherical valve body 226 rests on this seat 225. A plunger 227 in contact with the valve body 226 is surrounded by an electromagnetic coil 228. With this coil being turned on with an electric current, it will make a stroke along the axis of casing so as to move the valve body 226 up and down.

As the plunger 227 displaces the valve body 226, the cross-sectional area of internal passage 221 will vary to change the flow rate of fuel advancing from the inlet end 222 to outlet end 223. A current regulator not shown but varying the intensity of electric power applied to the proportional control valve 217 will serve to control the fuel flow rate through the return channel.

The fuel stream effluent from the tank 214 will continuously be compressed in the electromagnetic pump 215, before entering the spraying nozzle 205.

The thus compressed fuel stream of a high pressure will reach the spray mouth that is located at a distal end of the spraying nozzle 205, so that a noticeable portion of such a fuel stream is blown outwards to form a mist. The remainder of said fuel stream will flow back from this nozzle 205, through the check valve 216 and into the inlet end 222 of proportional control valve 217. The remainder having entered this valve 217 through its inlet end 222 is delivered to an upstream region of the feed channel, at a flow rate determined by the intensity of current being applied to said coil 228.

Gradual change or certain fluctuation in the temperature of the proportional control valve 217 has been observed in the related art combustion apparatus 201 during its operation. Such a change or fluctuation as being caused by the change in ambient temperature and/or the like will in turn change the temperature of coil 228 installed in the casing 220. Electric resistance of the coil 228 will vary in response to the change in its temperature, thereby rendering unstable the current intensity applied to the coil 228. Consequently, the flow rate at which the remainder of fuel stream flows back through the return channel will become unreliable. It has been somewhat difficult for the related art apparatus 201 to precisely regulate the spraying rate of fuel, failing to stabilize the condition of combustion state.

Such an unstable combustion in the related art apparatus does mean that the amount of a fuel sprayed out of said nozzle would not be burnt completely. Incomplete combustion will result in the discharge of a non-burnt fraction, bringing about a poorer efficiency of energy. In addition, an unnegligible amount of toxic gasses such as carbon monoxide is likely to be discharged to the outside, and an undesirable accumulation of soot will take place inside the apparatus. Thus, the problem of environmental pollution has been inherent in the related art combustion apparatuses, not only rendering them likely to become out of order.

SUMMARY OF THE INVENTION

An object of the present invention made in view of the problems and drawbacks mentioned above is therefore to provide an advanced combustion apparatus that is simplified in structure, but is nevertheless possible to accurately regulate the sprayed rate of a fuel to ensure complete combustion.

In order to achieve this object, a combustion apparatus provided herein has to comprise, as defined in the accompanying claim 1, a spraying means for spraying a fuel to be burnt, a fuel channel (otherwise known as "a fuel canal") for flowing the fuel therethrough, and a fuel pump disposed in the fuel channel so as to compress the fuel flowing towards the spraying means. The combustion apparatus has to comprise further an intermittently operating valve disposed also in the fuel channel so that a valve body of the valve will be driven to close and open the channel intermittently or periodically, and also a valve controller to control the timing at which the valve body is driven to close and open the channel.

A valve body of the intermittently operating valve is to be driven to intermittently or periodically close or open the channel, for the purpose of changing or varying a flow rate of the fuel. Instead of operating the proportional control valve to directly change the degree itself to which it is opened, the present apparatus can now be controlled to regulate the frequency at which it must repeat to open. Such a mode of adjusting the spraying rate of fuel will not be adversely affected by any change in ambient temperature or the like, thus avoiding any fluctuation or variation in the spraying rate that would otherwise make it difficult to ensure stable combustion.

In the present apparatus, the timing at which the intermittently operating valve is repeatedly closed and opened will be regulated to control the flow rate of the fuel flowing through a fuel return channel. Any disturbance such as a variation in the pressure of the fuel being fed to the nozzle, will be canceled or compensated. This action is effected herein by adjusting the timing of closing and opening this valve, thereby further stabilizing the combustion process.

Stable combustion now afforded herein will minimize the amount of toxic gases such as carbon monoxide and the amount of soot likely to be produced during a combustion process. The apparatus is favorable from a viewpoint of protecting environment from pollution and also protecting the apparatus itself from any damage.

As defined in the accompanying claim 2 dependent on claim 1, the valve controller may be designed to perform a duty ratio control or PWM control for the closing and opening of the valve body.

In this case, the flow rate of the fuel flowing through the return channel will be controlled based on the ratio to a unit time of an overall period in which the valve body is repeatedly open. Ambient temperature around or in the intermittently operating valve will not affect the accuracy of control, thus ensuring stable combustion of sprayed fuel of a volume corresponding to any required or desired amount of heat to be generated.

An amount of heat to be generated per unit time is proportional to an amount of fuel to be burnt per unit time, which in turn is substantially equal to an amount of fuel to be sprayed per unit time.

As defined in the accompanying claim 3 dependent on claim 1, the valve controller may be designed to control the valve body to open and close the channel synchronously with an alternating current driving the fuel pump.

As defined in the accompanying claim 4 dependent on claim 1, the valve controller may be designed to control the valve body to open and close the channel synchronously with the timings of zero-crossing signals generated in an alternating current driving the fuel pump.

As defined in the accompanying claim 5 dependent on claim 1, the valve controller may be designed to control the valve body to open the channel on the basis of detection of every zero-crossing signal that is produced in an alternating current driving the fuel pump.

In the modes defined in the accompanying claims 3 to 5, there is a possibility that the fuel feeding pressure appearing within the feed channel and towards the spraying means may pulsate corresponding to the frequency of said alternating current (power source). However, the intermittently operating valve in the return channel will be opened and closed synchronously with an alternating current power source driving the fuel pump, so as to cancel such pulsation of the fuel feeding pressure. Because almost no fluctuation is thus observed in this pressure, stable combustion will be ensured in the apparatus of the present invention.

As a result, the fuel will be sprayed in a constant pattern regardless of the required amount of heat or the flow rate at which the fuel is sprayed and burnt. The mixture of fuel and air will continue to be uniform and constant, also stabilizing combustion in this apparatus.

Also, a flame of the fuel thus burnt will not pulsate, thereby diminishing combustion noise.

As defined in the accompanying claim 6 dependent on claim 1, pressure relief may be executed either after or before combustion process, by keeping open the intermittently operating valve for a given duration.

A portion of the fuel that is being forced into the spraying means by the pump in the feed channel will be left unburnt to reflux into the return channel at a considerably high pressure.

The intermittently operating valve will remain closed after combustion of the fuel has ceased, so that a certain zone in the return channel becomes a tightly closed chamber. This chamber would be of a high pressure due to the compressed fuel, thus loading said valve with an extreme pressure that is likely to impair durability thereof In addition, a rise in ambient temperature and a consequent rise in the pressure of stagnant fuel would also cause deterioration of the valve.

Such a consequent irregular rise of the internal pressure might happen, even if the internal pressure of return channel is not so high immediately after combustion has ceased in the apparatus. At an initial stage of resuming the combustion of fuel, the internal pressure thus having irregularly risen will cause a variation in the spraying pressure and disable smooth and stable combustion.

The pressure relief conducted after or before every combustion process, as noted above, will make the internal pressure of return channel almost equal to atomospheric pressure so as to avoid the problem just mentioned above.

If conducted immediately after the combustion process, the pressure relief for relieving such an extreme pressure will be more effective to protect the intermittently operating valve from deterioration.

As defined in the accompanying claim 7 dependent on claim 1, a pre-combustion pressure relief may be executed before combustion process, with a post-combustion pressure relief being executed after the combustion process. In the pre-combustion pressure relief, the intermittently operating valve will be kept open for a shorter time, with this valve being kept open for a longer time in the post-combustion pressure relief.

Any initial variation of the spraying pressure is thus avoided when resuming the combustion process. Further, any abnormal rise in pressure of the return channel, which might result in deterioration of the intermittently operating valve, is avoided.

The post-combustion pressure relief is effective to reduce the internal pressure of feed and return channels to such a noticeable degree that the pre-combustion pressure relief can be completed within a shorter time. The internal pressure of both the feed and return channels will be relieved surely to stabilize combustion.

A regular operation of the apparatus to burn the fuel can thus be started earlier after such a shortened period of the pre-combustion pressure relief.

The present inventors seeking for stable combustion in the apparatus have found as a result of their experiments that a certain gradual decrease in the internal pressure of a fuel compressing means such as a pump was unavoidable. A significant variation of said pressure was observed when resuming the next combustion processes, thus resulting in an unstable spraying rate and incomplete combustion of the fuel.

The resolution of this problem will be given herein as defined in the accompanying claim 8 dependent on claim 1. In this mode of invention, lapse of time may be measured from a preceding termination of combustion process until a succeeding resumption thereof. An ignition controller employed herein will modify the spraying rate of fuel at the beginning of a resumed combustion process, properly on the basis of such a measured time lapse.

The ignition controller may be designed to previously estimate and suppose, just before re-ignition, the spraying pressure that will appear when resuming combustion process. The spraying pressure as well as the spatial configuration of a sprayed fuel mist are optimally controlled in this way to make smooth the resumed combustion of said mist.

Re-ignition will thus ensure complete combustion, scarcely producing soot or tar, under any conditions of operation of this apparatus.

As defined in the accompanying claim 9 dependent on claim 1, lapse of time may likewise be measured from a preceding termination of combustion process until a succeeding resumption thereof. However, the spraying rate of fuel when re-igniting it will be reduced if the measured time lapse is equal to or longer than a given reference time, than other spraying rates intended for any other time lapse shorter than this reference time.

If the time lapse to be measured in comparatively short, then the fuel feeding compressing means will maintain well its high internal pressure, allowing the fuel to be sprayed smoothly even at a relatively high rate. If in contrast the time lapse is much longer, then said internal pressure will have leaked outwards and/or possibly have decreased due to contraction in the apparent volume of stagnant fuel having cooled down. The reduced spraying rate to be adopted in the latter case as noted above will provide a proper fuel mist contributing to an optimal re-ignition.

Also in the latter case, such a reduced amount per unit time of the sprayed fuel will be useful to diminish the quantity of soot and/or tar, even if not smoothly ignited under any operating conditions of the apparatus.

As defined in the accompanying claim 10 dependent on claim 1, the apparatus may further comprise an air-blowing means for positively supplying air to be consumed in combustion of the fuel, as well as an ignition controller employed herein that will modify the spraying rate of fuel at the beginning of a resumed combustion process, properly on the basis of such a measured time lapse. In this specification, an air-blowing means includes a blower, a fan and a compressor.

In this mode, the ratio of an amount of fuel being ignited and an amount of the air being blended therewith will be optimized for the purpose of improving smoothness of ignition and also diminishing production of soot and/or tar.

As already discussed above, the time lapse from the previous termination of combustion to the subsequent resumption thereof is likely to be accompanied by change in volume of the fuel during this lapse of time. These changes will render inconstant the spraying rate or pressure and the state of combustion. Therefore, as defined in the accompanying claim 11 dependent on claim 1, the apparatus may further comprise an ignition controller. The spraying rate of fuel when re-igniting it will be reduced in this case, if a measured fuel pressure is lower than a given reference value, than other spraying rates intended for any fuel pressures equal to or higher than this reference value.

The fuel will form in this case a well-stabilized mist to be completely burnt, irrespective of the spraying pressure, high or low.

From a further aspect of the invention as defined in the accompanying claim 12, the combustion apparatus comprises a spraying means for spraying a fuel to be burnt, a fuel channel for flowing the fuel therethrough, and a fuel pump disposed in the fuel channel so as to compress the fuel flowing towards the spraying means. The apparatus further comprises an intermittently operating valve disposed in the fuel channel so that its valve body is driven to close and open the channel intermittently or periodically at regular and variable intervals by the duty-ratio control. Frequency at which the duty-ratio control is repeated may be adjusted responsive to the required amount of heat to be generated. The duty-ratio control relates to the whole one-cycle period in which the valve repeats to be opened and closed, and also relates to an overall opened time in which the valve stands open (but not closed) several or many times during the whole period.

In this case, the number of times to open the intermittently operating valve can be varied within a unit time and in response to the varying required amount of heat or amount of fuel to be burnt. Even if such a frequency of duty-ratio control actions is altered, it will be possible to maintain the overall amount of fuel sprayed and burnt and the thus generated heat within the unit time not changed to any significant extent. In other words, the number of times to open the intermittently operating valve can be increased or decreased. If the said number of times is decreased, the valve will make a reduced noise when it repeats to open or be closed.

The manner in which the intermittently operating valve operates to control the flow rate of fuel that is flowing through the fuel channel and being sprayed out from the spraying means, is highly precise. In other words, only an accurate portion of the fuel corresponding to the required amount of heat will actually be sprayed and then burnt completely and efficiently.

The present combustion apparatus will operate in a preferable manner under certain conditions in which the duty-ratio is comparatively small. If in this case the one cycle time that is a unit time in which the valve operates one time to open and be closed thereafter is made considerably short, then a "theoretical open time" estimated and necessary for valve body to be at its full open position, will become extremely short.

The "valve-moving time" which the valve body takes in order to move to such a full open position will not be negligible relative to the "theoretical open time", unless the latter time is sufficiently long. In other words, if the "theoretical open time" is made so short, then discrepancy between it and an "actual open time" in which the valve body stands full open will become increase to an unallowable extent. In such an event, not only the flow rate of fuel flowing through the intermittently operating valve, but also the other flow rate at which the fuel is being sprayed out, will become almost out of control.

According to the present invention made in view of such a possible inconvenience, a preferably long one cycle time in which the valve operates one time to open and be closed thereafter can be used, even if a considerably small duty-ratio is selected corresponding to the required amount of heat to be generated. The valve-moving time will thus be made negligible relative to the theoretical open time, thereby minimizing non-preciseness or error in the spraying rate.

Stable and complete combustion thus ensured will diminish by-production of toxic gasses such as carbon monoxide in favor of protection of environment, and also will reduce the amount of soot produced and accumulated to injure the apparatus.

As defined in the accompanying claim 13 dependent on claim 12, the duty-ratio control involves a plurality of hypothetical regions that have different frequencies of the duty-ratio control in relation to the required amount of heat to be generated per unit time.

This mode will also be useful to spray the fuel at a proper rate meeting the required amount of heat to be generated in a unit time, avoiding any incomplete combustion and reducing the noise that the intermittently operating valve will make.

As also defined in the accompanying claim 14 dependent on claim 12, the apparatus may further comprise a valve controller for controlling the intermittently operating valve with action relying on a plurality of electronics tables each being an array of valve-operating data, such that the frequencies of the duty-ratio control differ from each other between the tables, and one of them will be selected to match a required amount of heat to be generated.

Thus, the most preferable frequency can be preset to control the intermittently operating valve, in order to generate an exact amount of heat required.

A series of tests was carried out by the present inventors to compare the levels of noise made by the apparatus during its operation under varied conditions. In a case wherein the flow rates of fuel being burnt are comparatively higher, the noise of intermittently operating valve almost melted into combustion noise. If however said rates are considerably lower, then said noise of the valve was somewhat offensive to the ear.

Therefore, as defined in the accompanying claim 15 dependent on claim 12, the one cycle time in the duty-ratio control may be prolonged for comparatively lower amount of heat required to be generated per unit time, corresponding to comparatively lower flow rates of the fuel being sprayed and burnt.

The number of times for the intermittently operating valve to open and then be closed will thus be reduced to diminish the overall level of noise, not causing any change at all in a current fuel flow rate.

From a still further aspect of the invention as defined in the accompanying claim 16, the combustion apparatus comprises a spraying means for spraying a fuel, a fuel channel for flowing the fuel therethrough, and a fuel pump disposed in the fuel channel so as to compress the fuel flowing towards the spraying means. The apparatus further comprises an intermittently operating valve disposed in the fuel channel so that a valve body of this valve will close and open the channel periodically at regular and variable intervals by the duty-ratio control. The valve body will fully close the channel when it is at a first position, whereas it will fully open the channel when it is at a second position. Frequency at which the duty-ratio control is repeated may be adjusted responsive to the current flow rate of the fuel being burnt, in such a manner that if the ratio of "a first time length for the valve body to move once from the first position to the second position and then back from the second position to the first position" divided by "a second time length in which said valve body remains at the second position during one cycle of said duty-ratio control" does exceed a threshold, then one cycle time in the duty-ratio control will be prolonged.

The percentage of the first time in the second time, that is the ratio of a "valve-moving time" which the valve body takes in order to move to its full open position and then return to its closed position to an "actual open time" in which the valve body remains open, may possibly exceed threshold. In such an event, a difference between a "theoretical open time" in which said valve body must remain open and the actual open time will increase to an undesirable extent, likely to cause impermissible error in the actually sprayed amount per unit time of the fuel.

However, in the control mode offered in the accompanying claim 16, the valve-moving time is rendered negligible relative to the theoretical open time, thus stabilizing combustion of fuel.

As defined in the accompanying claim 17 dependent on claim 16, the duty-ratio control may be conducted in such a manner that in a case wherein the duty ratio for causing the intermittently operating valve to open does exceed a reference value, one cycle time in the duty-ratio control will be prolonged.

In the case just mentioned above, the theoretical open time will tend to be extremely short so that the actual open time would become much shorter than the theoretical open time. However, the apparatus employed in the claim 17 will minimize the difference between the actual and theoretical open times so as to almost eliminate the error in the spraying rate and the amount of generated heat, whether the duty ratio is undesirably large or sufficiently small.

The fuel pump as recited in the accompanying claim 16 may be driven with an alternating current from a power source driving the fuel pump. In this case, pulsation of the current may possibly cause the unstable spraying of fuel.

Therefore, as defined in the accompanying claim 18, the valve controller may be designed to open and close the valve body synchronously with the timings of zero-crossing signals generated in an alternating current driving the fuel pump.

Thus, a stable spray of fuel will be ensured even if the pump is driven with such an alternating current.

The present inventors have conducted test operations of apparatuses that involves intermittently operating valves as the means for regulation of the spraying flow rate of fuel, so as to find that a stable combustion would be realized if the valve were driven with a current of a frequency adjusted taking into account the change in fuel temperature. In detail, in a conventional combustion apparatus employing a return type nozzle as the spraying means and if the temperature of fuel flowing circulatingly through the fuel channel were considerably high, the fuel having become less viscous would form eddies in a region of the nozzle adjacent to its spray mouth, thereby increasing flow resistance in this region against the fuel flow. Consequently, an excessive portion of the fuel was observed to flow back into the return section of the fuel circuit, thereby tending to show a shortage in the amount of fuel sprayed in a unit time.

From another aspect of the invention as defined in the accompanying claim 19, the combustion apparatus comprises a spraying means for spraying a fuel, a fuel channel for flowing the fuel therethrough, and a fuel pump disposed in the fuel channel so as to compress the fuel flowing towards the spraying means. The apparatus further comprises an intermittently operating valve disposed in the fuel channel so that the valve will be closed and opened periodically at regular and variable intervals by a duty-ratio control, and a temperature sensing means also disposed in the fuel channel in order to detect the temperature of fuel. The intermittently operating valve is to be driven at a frequency that is adjusted based on the temperature detected by the sensing means.

Even if any change in fuel temperature tends to undesirably vary the flow resistance and the spraying rate, such a tendency will now be compensated not to affect the spraying rate, by altering the frequency of current to adjust the feed rate of fuel flowing towards the nozzle.

Under such a condition that higher temperatures of the fuel are likely to decrease the viscosity and increase the flow resistance against the fuel within the spraying means, it may be preferable to adopt a lower level of the duty ratio for the intermittently operating valve.

However, lower duty ratios would increase the percentage "valve-moving time" in the "actual open time" for the valve body to remain open, as discussed above. In such an event, a difference between "theoretical open time" in which said valve body must remain open and the actual open time will increase to undesirably cause impermissible error in the actually sprayed amount of fuel per unit time.

Therefore, as defined in the accompanying claim 20 dependent on claim 19, the frequency of electric current for driving the intermittently operating valve will be lowered if and when the temperature detected by the sensing means is above a reference temperature.

Flow rate of the fuel being sprayed and burnt will thus be maintained at a desired level so as to maintain amount of heat generated per unit time, without any fear of suffering from any disturbance that would otherwise be caused by the varying fuel temperature.

THE PREFERRED EMBODIMENTS

Figure 1:
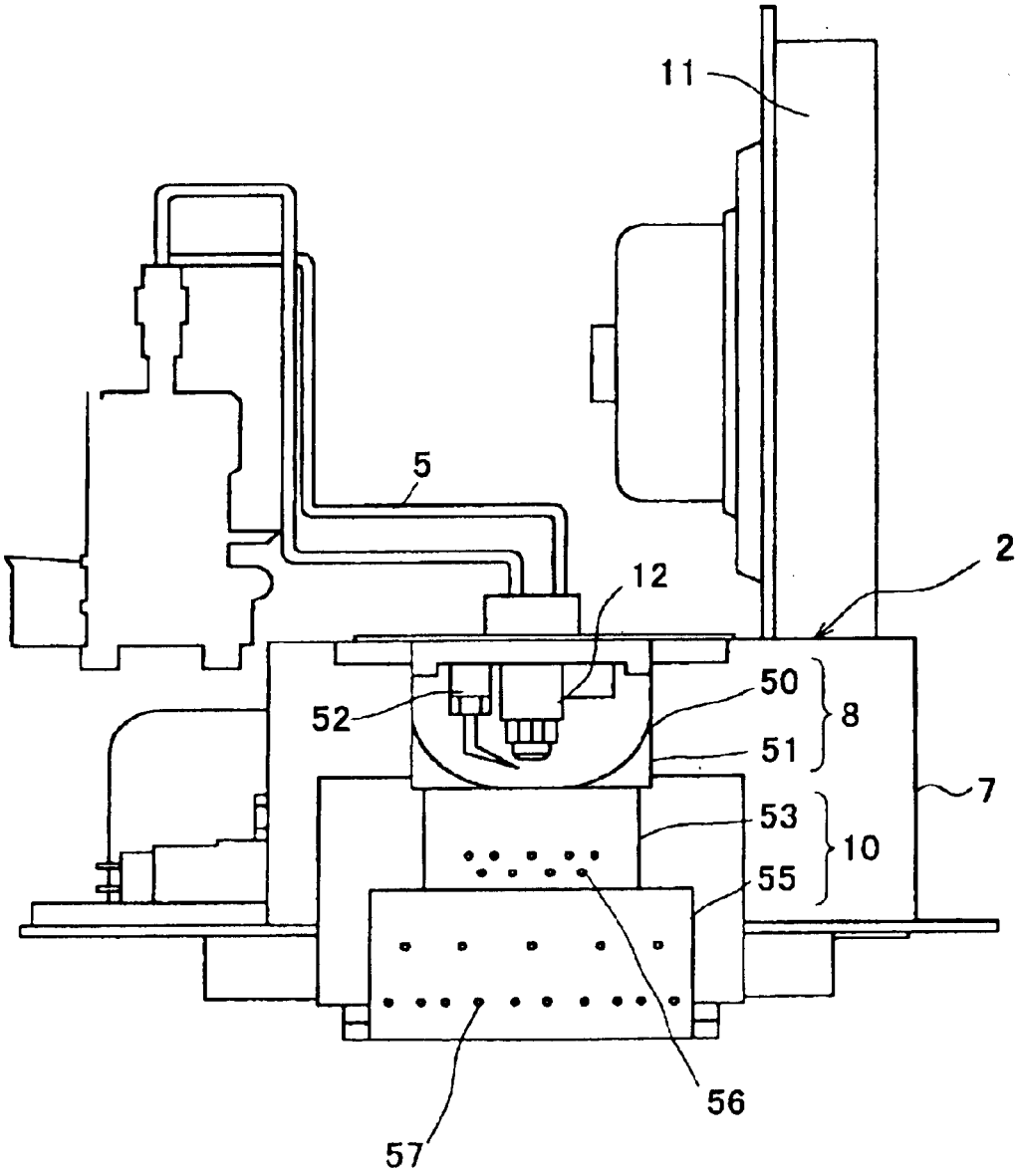
FIG. 1 is a schematic front elevation of a combustion apparatus provided in an embodiment of the present invention.

In FIG. 1, a combustion apparatus of a first embodiment is generally denoted at the reference numeral 2. This apparatus 2 comprises a nozzle block 8 having an end opened in a hollow shell 7, and a combustion chamber 10 is attached to the end of nozzle block 8. A fan or blower 11 mounted on the shell 7 will operate to feed the ambient air into the combustion chamber 10. A fuel spraying nozzle (as the spraying means) 12 is installed in the nozzle block 8 in order to spray a fuel towards and into the combustion chamber 10.

The spraying nozzle 12 has a spray mouth (not shown) for jetting the fuel. An internal feed path (not shown) and an internal return path (not shown) leading to or starting back from the spray mouth are formed in or for the nozzle 12. Thus, the fuel spraying nozzle 12 will operate to jet a portion of the fuel that is being fed from the outside through the internal feed path. The remainder of said fuel will be left unsprayed to subsequently flow back through the internal return path.

Figure 2:
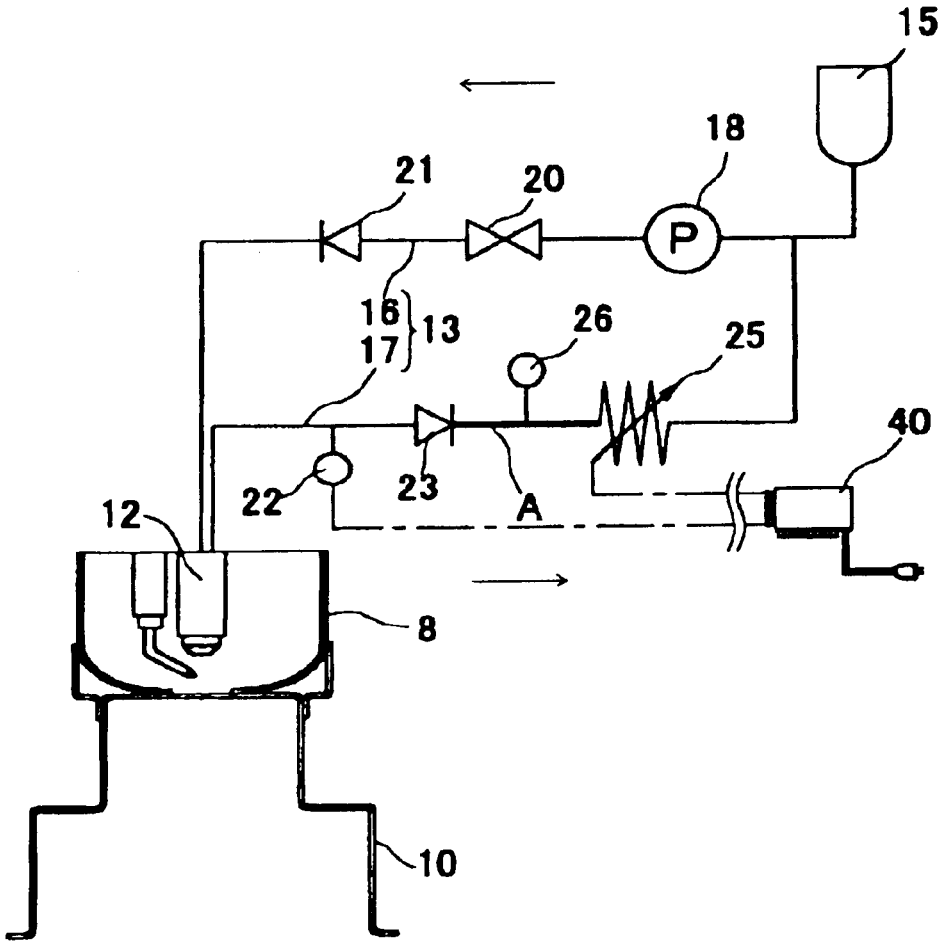
FIG. 2 is a diagram showing a fuel pipe line that is constructed in the apparatus shown in FIG. 1.

As seen in FIG. 2, a fuel pipe line 13 connects the fuel spraying nozzle 12 to a fuel tank 15 holding therein a mass of the fuel. The pipe line 13 consists mainly of a fuel feed canal (i.e., a feed channel) 16 and a return canal (i.e., a return channel) 17, such that the former canal communicates with a fuel feed path formed in the nozzle 12 and the latter canal 17 communicates with a return path also formed in the spraying nozzle 12. As shown in FIG. 1, pipes 5 forming those feed and return canals 16 and 17 extend outwardly of the shell 7 so as to lead to an injector valve 25 and an electromagnetic pump 18, that are detailed below. Those pipes 5 also connected to the nozzle 12 are each bent several times at substantially right angles between the nozzle and the valve 25 or pump 18. Bends formed thus in said pipes will make same more tenacious on one hand, and will attenuate any vibration being transmitted from said pump 18 or injector valve 25 on the other hand. Thus, such a vibration will scarcely reach the spraying nozzle 12, thereby protecting it from damage.

The feed canal 16 combining the nozzle 12 with the fuel tank 15 in series does serve to supply the nozzle with the fuel stored in the tank. Disposed in this canal 16 are the electromagnetic pump 18, an electromagnetic valve 20 and a check valve (as a feed channel checking means) 21. The check valve 21 normally stands closed, and an activation pressure (that is a minimum actuating pressure) for opening this valve is higher than a maximum hydrostatic head of the fuel in tank 15 standing in fluid communication with the feed canal 16. In other words, the hydrostatic pressure caused by the fuel stored in the tank 15 will never exceed the minimum pressure for activating the checking valve 21 to open. For example, in the combustion apparatus 2 of the present embodiment, the fuel tank 15 is disposed higher than the valve 21 by 0.5 meter. The minimum actuating pressure is 0.2 Kgf/cm$^2$ (viz., 2.0×10$^4$ Pa) for this valve 21, that is much higher than the hydrostatic head 0.04 Kgf/cm$^2$ (viz., 0.39×10$^4$ Pa) for the fuel in tank 15. Thus, the fuel will not flow towards the spraying nozzle 12 unless the pump 18 compresses it. Although the minimum actuating pressure for said valve 21 is selected herein to be high by about 5 times of said hydrostatic head of said fuel, the ratio of the former to the latter may fall within a range from 3 to 5.

The fuel tank 15 may alternatively be positioned at any height, from 1.5 m above to 2.0 m below the valve 21, thus making the hydrostatic head not higher than 0.12 Kgf/cm$^2$ (viz., 1.2×10$^4$ Pa).

As noted above, the normally closed check valve 21 shall not naturally open merely due to hydrostatic head of the fuel in tank 15. There may be a possibility that the electromagnetic valve 20 would unintentionally open, though fuel feed to the nozzle 12 had to be interrupted for the combustion apparatus 2 then standing inoperative. Even in such an accident, the check valve 21 will surely stop the fuel not to leak out towards a downstream canal region. If and when the fuel from the tank 15 has to be sprayed, it will be compressed by the pump 18 and enabled to pass through the valve 21 and flow to the nozzle 12.

A portion of the fuel fed to the nozzle 12 will be left there unburnt, and such a remainder will flow back towards the tank 15 through the return canal 17. A downstream end (near the tank 15) of the return canal 17 merges into the feed canal 16 at its intermediate point located on the upstream side of electromagnetic pump 18 (and facing the tank 15). Disposed at another intermediate point of the return canal 17 is a temperature sensor (viz., temperature sensing means) 22 for detecting the temperature of fuel flowing back through this canal. A further check valve (as the return channel checking means) 23 is disposed downstreamly of the sensor 22 so that the fuel can flow towards the tank 15 but is inhibited from flowing in a reversed direction away from this tank. Disposed on the downstream side of the check valve 23 is the injector valve (viz., intermittently operating valve) 25 that will be opened and closed periodically at given time intervals. An accumulator 26 intervening between the injector valve 25 and the further check valve 23 will serve to buffer fluctuation in pressure of the fuel flowing through the return canal 17.

Figure 3:
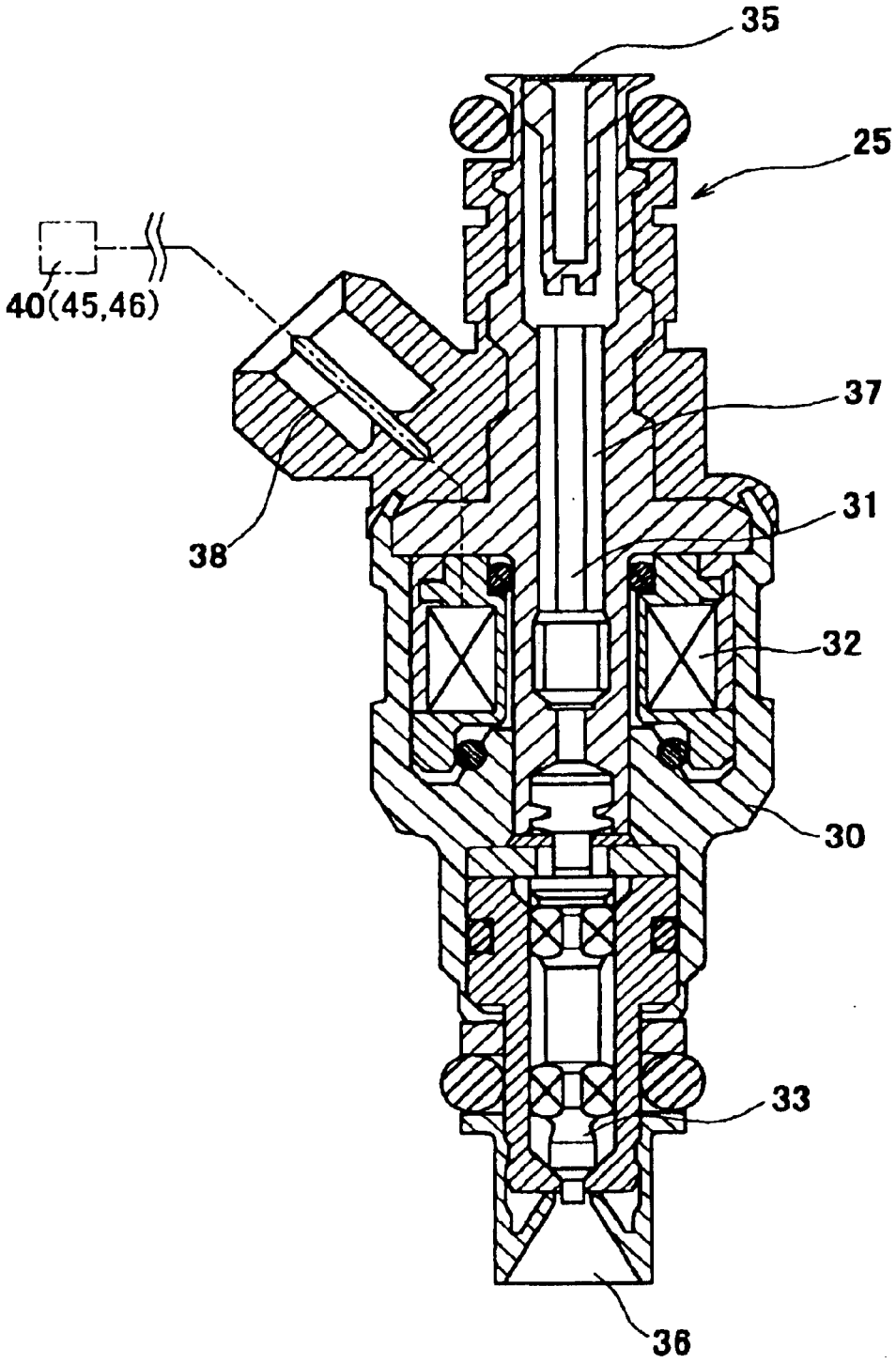
FIG. 3 is a cross section of an injector valve incorporated in the apparatus of FIG. 1.

The injector valve 25 will operate at an extreme high frequency to be opened and then instantly closed. As shown in FIG. 3, this valve25 comprises a casing 30, an actuator 31 held therein, an electromagnetic coil 32 for driving the actuator 31, and a valve body 33 movable in unison with the actuator 31. Formed at opposite ends of the casing 30 are a fuel inlet 35 and a fuel outlet 36, with an internal fuel passage 37 extending between them 35 and 36 and through the casing 30.

The casing 30 has a terminal 38 leading to the electromagnetic coil 32 so that power supply through this terminal 38 will activate said coil 32. Consequently, the actuator 31 will be energized within the casing 30, thereby simultaneously driving the valve body 33 to open the passage 37 that is a part of the return canal 17. The valve body 33 of the present embodiment thus opens the passage 37 instantly in response to the coil 32 energized with an electric current, and said body 33 will close the passage instantly upon inactivation of said coil 32. The injector valve 25 in such a closed state in response to inactivated coil 32 will have its valve body 33 very tightly shutting the fuel passage 37 to absolutely close the return canal 17.

The terminal 38 is connected to a controller 40 that is incorporated to regulate the spraying rate of fuel jetting from the nozzle 12 and also to regulate the operation of fan or blower 11. The controller 40 is designed to periodically or intermittently activate the coil 32 to displace the valve body 33 to open and to close the passage, thus controlling the flow rate of fuel being sprayed from the nozzle 12.

The controller 40 will apply to the electromagnetic coil 32 a pulse current that is generated synchronously with pulse wave of the power source for electromagnetic pump 18. This pulse current will be detailed below.

Figure 4:
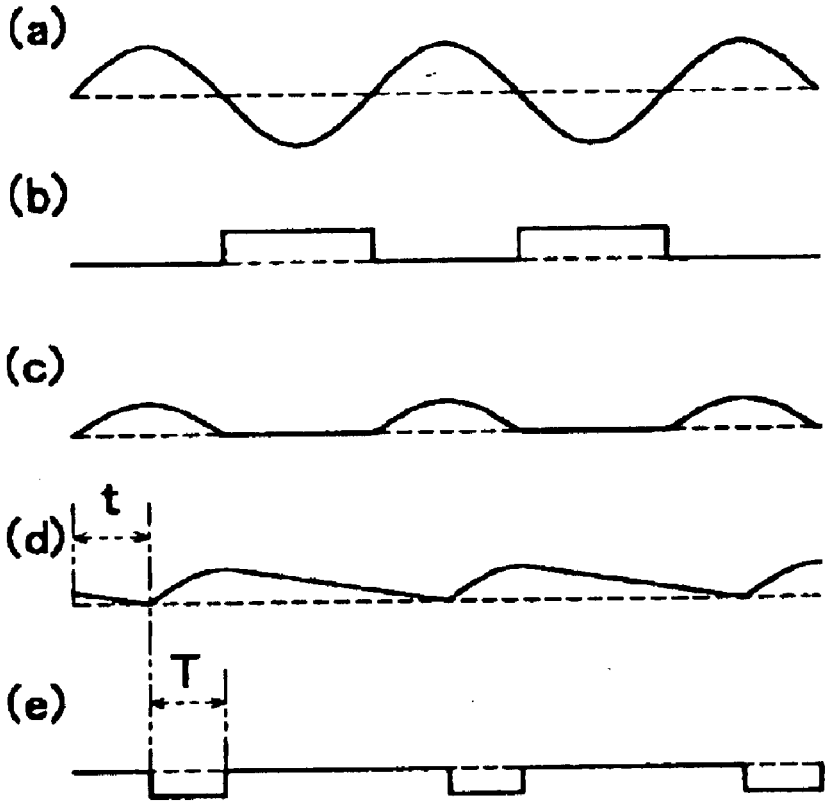
FIG. 4 is an array of graphs (a) to (e), in which the graph (a) represents the periodic variation in an electric current that is applied from a power source to a pump of a combustion apparatus provided in an embodiment of the present invention, the graph (b) represents a sequence of zero-crossing signals that will be generated based on the periodic variation shown in the graph (a), the graph (c) represents the periodic variation in the electric current shown in the graph (a) but rectified, and the graph (d) represents a sequence of periodically varying discharging pressure of the pump to which the electric current shown in the graph (c) is applied, with the graph (e) representing a train of pulse signal applied to an injector valve.

Applied to the pump 18 is an alternating current, whose phase inherently showing a periodic change illustrated in FIG. 4(*a*) will have been rectified as shown in FIG. 4(*c*). Discharge pressure at the outlet of pump 18 will thus pulsate also periodically but with a certain delay time 't', as will be seen in FIG. 4(*d*). The controller 40 will detect successive points one by one where the alternating current to the pump 18 shows a zero level, every time generating a zero-crossing signal. After a delay time 't' has elapsed from each trailing edge of such a zero-crossing signal, a pulse current will instantly be generated by the controller 40 so as to continue for an opened-valve's period 'T'. This period 'T' will be determined to provide a required amount of heat to be produced by combustion of the fuel in the apparatus 2.

The valve body 33 will become open instantly when the current starts to be input to the terminal 38, bringing the pulse train into its 'ON' state. However, the switching off of this current will bring the pulse train into its 'OFF' state, thus causing the valve body 33 to close the channel instantly.

In the control mode just summarized above, the quantitative requirement of heat that will be produced by burning the fuel at a flow rate 'Q' thereof will be met herein by appropriate methods such as the so-called 'PWM' control and the duty-ratio control. The PWM control denotes the control type of pulse width modulation. The duty-ratio control for the valve body 33 in the injector valve 25 is such that the ratio (viz., duty ratio) of a period of 'ON' (viz., the opening) to another period of 'OFF' (viz., the closing) of said valve body is changed to regulate the opened valve's period. For lower levels of the flow rate 'Q', the duration of 'ON' state will be rendered longer than the duration of 'OFF' state during each pulse, thereby holding the valve body 33 open for a longer time. Contrarily for higher levels of said rate 'Q', the duration of 'OFF' state will be made longer than the duration of 'ON' state during each pulse, thereby holding the valve body 33 closed for a longer time. The injector valve 25 in the return canal will operate in this way to change the timing at which its valve body does interrupt or permit the fuel flow, so that an effective flow rate of the fuel through the feed canal 11 may be adjusted.

It is noted here that the electromagnetic pump 18 always imparts a constant discharge pressure to a fuel flow that is being urged by this pump towards the nozzle 12 in this apparatus 2. Any change in the flow rate of the fuel being discharged from said pump will never affect the constant discharge pressure. Thus, the valve body 33 of injector valve 25 is always subjected to a constant pressure.

The valve body 33 will open the passage in response to a pulse current input to the terminal 38. A portion of fuel is thus blown back from the outlet of injector valve 25 at a constant return pressure, that is ensured by virtue of the constant discharge pressure of said pump. The amount of fuel having returned back through the injector valve 25 in a given period of time does depend on an overall time in which the valve body 33 has been open during this period.

Thus a constant amount of fuel per unit time flows through the valve at a constant pressure when the pulse current applied to the terminal 38 is "ON". Thus, the amount of fuel that will have passed the injector valve 25 can be regulated by means of the time period in which the valve body 33 will be kept open commanded by a pulse current held 'ON' during this time period. In more detail, the controller 40 will determine such a time period in which the valve 25 continues to receive such a pulse current held "ON", by the method of the so-called PWM control and/or duty-ratio control. Thus, the flow rate of fuel flowing back into and passing through the return canal 17 will be adjusted to realize a desired flow rate of said fuel to be burnt at the spraying nozzle 12.

So long as the apparatus is inoperative not to conduct combustion process, the controller 40 will interrupt the current to the coil 32, thus tightly closing the injector valve 25. The return canal 17 is thus closed at the two checkpoints, that is, the check valve 23 and injector valve 25.

As mentioned above and shown in FIG. 1, the spraying nozzle 12 is installed in the nozzle block 8. This block is a double cylinder composed of an inner cylinder 50 surrounding the nozzle and an outer cylinder 51 enclosing said inner cylinder.

The inner cylinder 50 covers the spraying nozzle 12 and an ignition plug 52 for inflammation of the fuel mist jetted from the nozzle. The combustion chamber 10 secured to such a nozzle block 8 is formed integral therewith. An air intake (not shown) disposed beside the inner and outer cylinders 50 and 51 will feed ambient air into the chamber 10 to be consumed in the combustion process.

The combustion chamber 10 is of a stepped shape as seen in FIG. 1 such that its first cylinder 53 fixed on the nozzle block 8 continues to a second cylinder 54. The second cylinder 54 has a diameter larger than that of the first one 53, thereby increasing stepwise the diameter of combustion chamber 10 towards its distal end remote from the nozzle 12.

The first cylinder 53 continuing from the nozzle block 8 has a perforated peripheral wall to have a multiplicity of air holes 56 arranged all around this cylinder, whereby ambient air will penetrate this cylinder to flow into the combustion cylinder 10.

Likewise, the second cylinder 55 continuing from the first one 53 has a perforated peripheral wall to have a multiplicity of further air holes 57 also arranged all around this cylinder, whereby a further amount of ambient air will penetrate this cylinder to flow into the combustion chamber 10.

The combustion chamber 10 thus increasing diameter towards its distal end is shaped in conformity with configuration of the stream of mist sprayed from nozzle 12. No noticeable quantity of fuel will not adhere to the inner surface of combustion chamber 10, and no remarkable gap will appear between this surface and the periphery of a flame produced during the combustion process.

The fuel being sprayed from the nozzle 12 will thus spread evenly throughout the combustion chamber 10, whereby combustion heat will be distributed to the chamber's wall and the interior of chamber also uniformly. Temperature distribution throughout this chamber 10 is now rendered so uniform that almost all the fuel particles sprayed from nozzle 12 will be completely burnt, without suffering from aggregation of them.

As noted above, the gap between the combustion chamber wall 10 and the flame is reduced and a sufficient amount of ambient air is introduced into the chamber through the air holes 56 and 57. Thanks to these structural features, the fuel sprayed into and flaming in said chamber is intermixed well with the ambient air so as to ensure complete combustion.

As also noted above, both the feed canal 16 to and the return canal from the spraying nozzle 12 are capable of being shut with two valves, that is, valves 20 and 21 or valves 23 and 25. Thus, the fuel tank 15 can be sealed tightly against these canals, whenever so required.

An inter-valve zone 'A' present between injector valve 25 and check valve 23 may tend to show a high pressure to injure either of these valves, because of a tightly closing nature of the injector valve 25. However, the accumulator 26 disposed in the return canal 17 and absorbing such a high internal pressure will effectively protect them from damage.

The related art fuel pipe line 209 in a combustion apparatus necessitates two or more electromagnetic valves, but they are usually expensive, bulky and cause waste of electric energy. In contrast, the fuel pipe line 13 forming the combustion apparatus 2 of the invention has only one electromagnetic valve 20 installed therein in combination of two check valves 21 and 23 and one injector valve 25. Thus, the present apparatus is rendered more compacted and capable of being manufactured inexpensively and operating with a reduced consumption of electric power, thus resolving all the drawbacks inherent in the related art apparatuses.

As the electromagnetic pump in the feed canal 16 discharges fuel in constant pressure, flow rate of fuel supplied to the spraying nozzle is quite constant. The injector valve 25 employed herein and disposed in return canal 17 does cooperate with the single electromagnetic valve 20 of feed canal, in a very preferable manner. The opening and closing of the former valve 25 is repeated fast and frequently at every instant, with the latter valve 20 constantly discharging the fuel, so that it will be sprayed at any accurate and desired rate from the spraying nozzle 12 into the combustion chamber 10 in a highly stable fashion. Thus, the fuel well mixed with ambient air within this chamber will exactly and efficiently produce a required amount of heat, without giving rise to any material loss of the fuel fed to the nozzle.

Stable and complete combustion of fuel in the apparatus 2 will minimize the amount of carbon monoxide or the like toxic gases and soot which incomplete combustion has been producing, thereby diminishing environ-mental pollution and breakdown of apparatus.

The controller 40 composed mainly of a CPU is connected to electric devices such as a blower 8, the electromagnetic pump 18 and the injector valve 25, either directly or indirectly through relays or the like. This valve 25 and the other devices will be controlled to realize target operational conditions of the combustion apparatus 2. Particularly, a task for this controller 40 may be a combustion control such as to cause the apparatus 2 to supply a required amount 'Q' of combustion heat. A further task may be an ignition control to ensure reliable ignition of the fuel when starting or resuming a routine combustion process. One of further tasks of the controller 40 is an internal pressure control to regulate the internal pressure of the canals 13. These three types of control will now be focused and detailed below, generally in this order.

Figure 5:
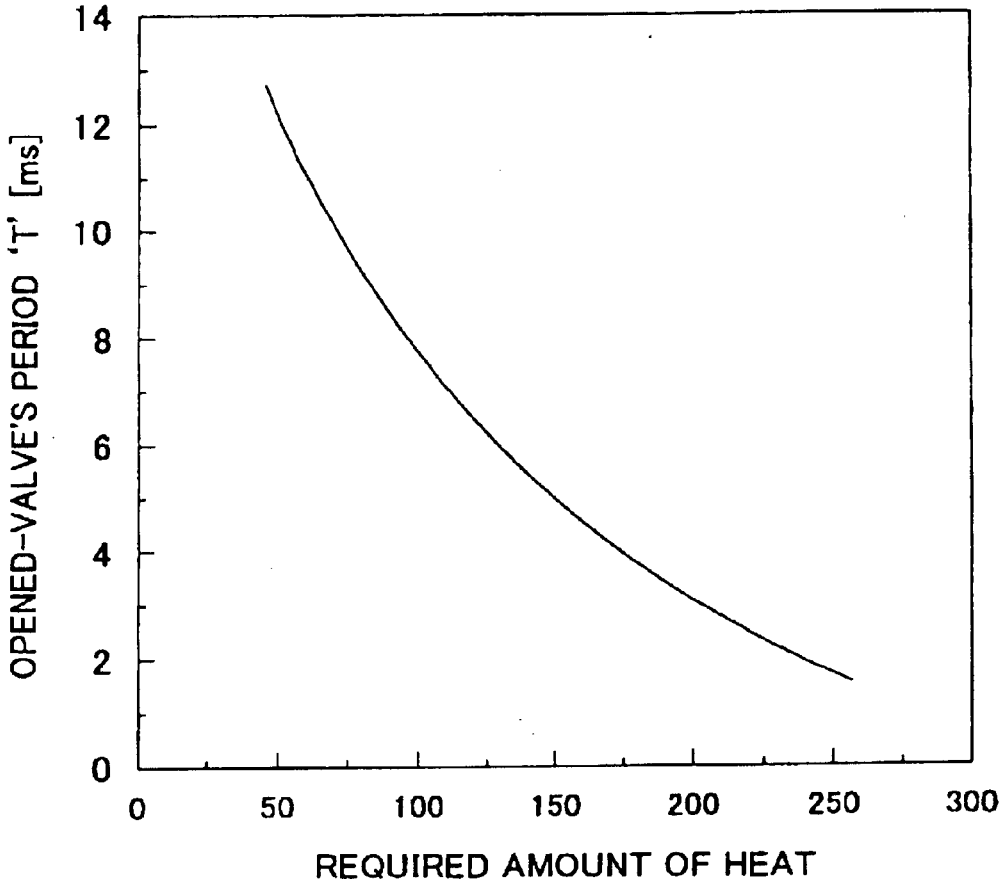
FIG. 5 is a graph showing the relationship found between the "required amount of heat to be generated per unit time" and the "overall time length in which the injector valve repeatedly stands open"

The controller 40 will perform the combustion control for the apparatus 2, using a duration-deciding program previously input to the CPU not shown. This program is intended to give an opened-valve's period 'T' in which the injector valve 25 will repeatedly and intermittently be kept open many times per unit time. Such a motion of the valve shall generate the required amount 'Q' of combustion heat. In detail, the duration-deciding program will decide the opened-valve's period 'T', by making reference to the relationship shown in FIG. 5 between this period 'T' for valve 25 and a required amount of heat to be generated per unit time, which is proportional to a required flow rate of the fuel to be burnt, which in turn is substantially equal to a required spraying rate of the fuel.

An elapsed timer (its symbolized abridgment being 'elt' hereinafter) installed in the controller 40 will start countdown upon lapse of delay time 't'. A valve-opening timer (its symbolized abridgment being 'vot' hereinafter) is also installed in this means 40. This timer 'vot' will start to count up the opened-valve's period 'T' upon completion of countdown done by the elapsed timer 'elt'.

The combustion apparatus 2 of the present embodiment will operate, conducting an electronics process as follows. The controller 40 controls the injector valve 25 in a manner as shown in the flow chart of FIG. 6. When the apparatus starts to operate, the controller 40 will compute at the first one "1" of successive steps "1" to "9" in FIG. 6 (hereinafter referred to as the steps 6-1 to 6-9, respectively) a required amount of heat to be generated, which correspond to a standard or target flow rate of the fuel to be sprayed. After calculating such a spraying rate to cause the apparatus 2 to generate a required amount of heat, the process advances to the next step 6-2.

At this step 6-2, the controller 40 will calculate the opened-valve's period 'T' for the valve 25. This calculation is done referring to the relationship shown in FIG. 5 between this period 'T', and based on the flow rate of fuel to be sprayed and burnt as determined already at the previous step 6-1. If any zero-crossing signal indicated as the graph (b) in FIG. 4 is detected at the next step 6-3, then the process advances to the succeeding step 6-4*a*. At this step, a delay time 't' will be set at the elapsed timer 'elt'. If contrarily no such a zero-crossing signal is detected at step 6-3, then the process goes to the other step 6-4*b* at which the elapsed timer 'elt' will start countdown.

After the setting of delay time 't' in the timer 'elt' at step 6-4*a*, or after the starting of countdown by the timer 'elt' at step 6-4*b*, a judgement will be done at the step 6-5 as to whether an incremental length of time 't'' has expired. If 'yes', then the process advances to the next step 6-6, but skipping to the next but one step 6-7 if judged 'No' at the step 6-5. At the step 6-6, a value of the opened-valve's period 'T' will be set in the valve-opening timer 'vot' so as to cause this apparatus 2 to generate a required amount of heat.

Subsequent to the setting of period 'T' in the timer 'vot', countdown will be commenced at the step 6-7 to incrementally decrease a time not yet elapsed. Then at the step 6-8, a judgment as to whether any remaining length of time 'T'' is or is not found within the opened-valve's period 'T' will be done. If judged affirmative, then a valve opening command signal will be generated for the valve 25 at the step 6-9. Consequently, a pulse current will be applied to the electromagnetic coil 32 in order to temporarily hold open the valve body 33 of the injector valve 25, that is disposed in the return canal 17.

If judged negative at step 6-8 indicating whether any time 'T'' remains in the period 'T', then the control process will advance to step 6-9'. In this way, once the injector valve 25 is opened at step 6-9, it will continue to be open until the valve-opening timer 'vot' returns to its home position that is a 'zero' point. When the initially preset period 'T' will have elapsed entirely, the control flow goes to the step 6-9' so that generation of the valve opening command signal will cease. Thus, the applying of an electric current to the injector valve 25 is interrupted to close this valve, before the process returns to the first step 6-1.

A hot water supply system employing the combustion apparatus 2 of the present embodiment is advantageous in that this apparatus comprises the injector valve 25 installed in the fuel return canal 17. Notwithstanding any change in ambient temperature, an accurate amount of the fuel per unit time will be sprayed from the nozzle 12 and burnt there at a constant pressure and at a proper rate corresponding to the amount of heat to be generated per unit time. The mist thus sprayed will form a constant pattern or configuration, so that the air introduced into the combustion chamber 10 is blended well with the fuel mist, causing same to be burnt smoothly and completely.

Such a stable combustion in the apparatus 2 will diminish the production of soot and toxic gases such as carbon monoxide, so that accumulation of soot should not impair the apparatus.

The controller 40 for the apparatus 2 is programmed to open the injector valve 25 after lapse of the given delay time 't'. Thus, the sequential variation in pressure of the fuel being discharged from the electromagnetic pump 18 will take place at timings not undesirably deviating from the other timings at which periodical variation tends to occur in the alternating current driving said pump 18. As a result, the variation in fuel pressure is now reduced remarkably such that the fuel will be sprayed under a constant pressure, thereby stabilizing combustion and diminishing combustion noise.

It will now be apparent that the injector valve 25 in the apparatus 2 is controlled to open and close the channel at a frequency matching the required amount of heat 'Q'. The flow rate of fuel being sprayed via nozzle 12 is thus precisely regulated not to be affected adversely by any change in ambient temperature. During normal operation of the apparatus, the internal pressure of the pump 18 compressing the fuel towards the nozzle 12 remains stable, thereby stabilizing the flow of mist sprayed into the combustion chamber 10 and mixing well the mist with air to ensure complete combustion.

It is however to be noted that within a period immediately continuing from the commencement of combustion in the apparatus 2, the fuel pressure will possibly be insufficient for full combustion of the fuel. In this case, the flow rate of fuel being burnt will be short of the required amount of heat to be generated. Further, a considerable length of time having lapsed after termination of a series of combustion commanding signals would possibly have caused leakage of the internal pressure of pump 18. Such a condition of the system may also bring about the same problem or inconvenience just mentioned above.

Therefore, the controller 40 for the apparatus 2 of the present embodiment is programmed to conduct an ignition control such that even in the two cases noted above the spraying of fuel starts smoothly as if the apparatus were performing its normal operation. In detail, if the internal pressure of pump 18 would be regarded as insufficient as in the initial period just after commencement of operation, the duty ratio 'r' of injector valve 25 will be raised to increase the ratio of a fuel portion re-turned back from the nozzle 12. Such a reduced flow rate of the fuel will be effective to avoid any misfire or incomplete combustion thereof. The ignition controlling method addressed to the possible problems and the counter-measure for resolving same will be described below with reference to the flow chart shown in FIG. 7.

At the step 7-1 of this program installed in the controller 40, a main switch (not shown) for running the apparatus 2 will be turned on at first. Then, the process advances to the step 7-2, where a judgement will be made as to whether a demand for combustion process does or does not exist at that instant during a current cycle of the data processing. If affirmative, then the process goes to the step 7-3.

The demand for combustion that will be detected at the step 7-2 is the first one appearing in the process. The internal pressure then existing in the pump 18 may be sup-posed not to be high enough to spray the fuel at a flow rate matching the required scale of combustion. Therefore, the value '0' (zero) will be selected to be written on a valve duty flag at the step 7-3, causing the controller 40 to adopt an adjusted duty ratio 'r' for the intermittently operating valve 25. In detail, the feed rate of fuel to the nozzle 12 will be optimized for example to be about 10–14 cc per minute, by adopting the duty ratio larger than that employed at the step 7-20. This means that the flow rate of fuel turning into the return canal 17 is increased to render the spraying rate lower than what is needed for the required amount of heat 'Q' to be generated per unit time.

The electromagnetic pump 18 will be turned on at the next step 7-4 so as to compress and feed the fuel to the spraying nozzle 12. As a result, the fuel will show a pressure enough to spray it to form a mist stream of desired configuration, within the first and second cylinders 53 and 55 of combustion chamber. The fuel mist will be mixed well with ambient air sucked through the air holes 56 and 57 formed in those cylinders.

Subsequently at the step 7-5, the ignition plug 52 will inflame the fuel mist sprayed into the cylinders 53 and 55, before this system shift itself to a proportional control mode at the step 7-6. At this step, the duty ratio 'r' will be adjusted again to correspond to the required amount of heat 'Q' necessary for the required amount of heat generated per unit time. The duty ratio 'r' thus newly selected will function to begin the proportional mode of control. Such a normal operation mode will continue in the manner as shown with the flow chart of FIG. 6, so that description of the details of this mode will not be repeated here.

At the further step 7-7, a judgement will be made again as to whether a current demand for combustion has ceased. If 'No', then the combustion process will continue. If 'Yes', then combustion will be interrupted at the next step 7-8, by closing the intermittently operating valve 25 and stopping the fuel feed to the nozzle 12.

Upon termination of combustion at the step 7-8, an interval measuring timer 'imt' will start to count up the time lapse $T_i$ at the step 7-9. This lapse is defined as a period from the recent stop of combustion in the apparatus 2, until the next demand for a combustion process to be made therein. Next, at the step 7-10, a further judgement as to whether the main switch of apparatus 2 is in its 'OFF' state will be done. If affirmative, then the series of controlling steps will end. If however negative, then the counting up of said interval will be continued, while judging yet again at the step 7-11 whether or not the next demand for a combustion process has been received by the controller 40.

If affirmative in the judgement made at the step 7-11, then the interval measuring timer 'imt' will be referred to in order to know a current time lapse $T_i$ at the step 7-12. Done also at this step is another judgment as to whether the detected actual time lapse $T_i$ is equal to or longer than a reference time lapse 'a' (for example 30 seconds in this embodiment). If affirmative, then the process advances to step 7-13. If negative, then it advances to step 7-20.

The reference time lapse 'a' is a criterion for supposingly determining whether the internal pressure of pump 18 is sufficiently high or not. If $T_i$ is judged to be shorter than the reference lapse 'a', then the apparatus 2 will be regarded as being still hot to indicate a relatively high internal pressure. In this case, a spraying flow rate (for example 20 cc/min) higher than that which was effected at the time when '0' (zero) was written on the valve duty flag at the step 7-3 would not disable sure inflammation of the sprayed fuel mist. If however $T_i$ is judged to be equal to or longer than the reference lapse 'a', then the apparatus 2 will be regarded as having cooled down to result in a relatively low internal pressure. In this case, the internal pressure of pump 18 may have leaked outwards to a considerable degree. The spraying flow rate (for example 20 cc/min) higher than that which was effected at the time when '0' (zero) was written on the valve duty flag at the step 7-3 would cause a misfire or an unsure inflammation of the sprayed fuel mist.

In the latter case of $T_i$ being equal to or longer than the reference lapse 'a', a processing defined as the steps 13, 14 and 15 similar to the respective steps 3, 4 and 5 will be done to ignite the sprayed mist. In detail, the value '0' will be written on the flag to select the fuel feed rate of about 10–14 cc/min, at the step 7-13. Then at the step 7-14 the pump 15 will be activated, so as to ignite the sprayed mist at the step 7-15.

If $T_i$ is judged to be shorter than 'a', suggesting a sufficient internal pressure of pump 18, then the value '1' will be written on the valve duty flag. The duty ratio of valve 25 is thus set at the flow rate of 20 cc/min, and subsequently the controller 40 will activate the pump 18 at step 7-21 and ignite the sprayed mist at step 7-22.

Subsequent to ignition of the fuel mist at the step 7-15 or 7-22, the process will shift itself to the proportional control mode at the step 7-16. At this step, the duty ratio 'r' will be adjusted again to correspond to the spraying rate necessary for the required amount of heat 'Q' generated per unit time. Frequency of the opening and closing the valve 25 is thus adjusted to match the required amount of heat 'Q', and the duty ratio 'r' thus newly selected will function to begin the proportional mode of control. Such a normal operation mode will continue in the manner as shown with the flow chart of FIG. 6. At the step 7-17, a judgement will be made again as to whether a current demand for combustion has ceased. If 'No', then the combustion process will continue, but if 'Yes', then combustion will be interrupted at the next step 7-18.

At the subsequent step 7-19, a judgement will be made as to whether the main switch of apparatus 2 is 'OFF'. If 'No', then the process will return to the step 7-9 for counting up the time lapse $T_i$. If 'Yes', then the controller 40 will end the sequential flow of the steps described above and stop the combustion process.

Figure 7:
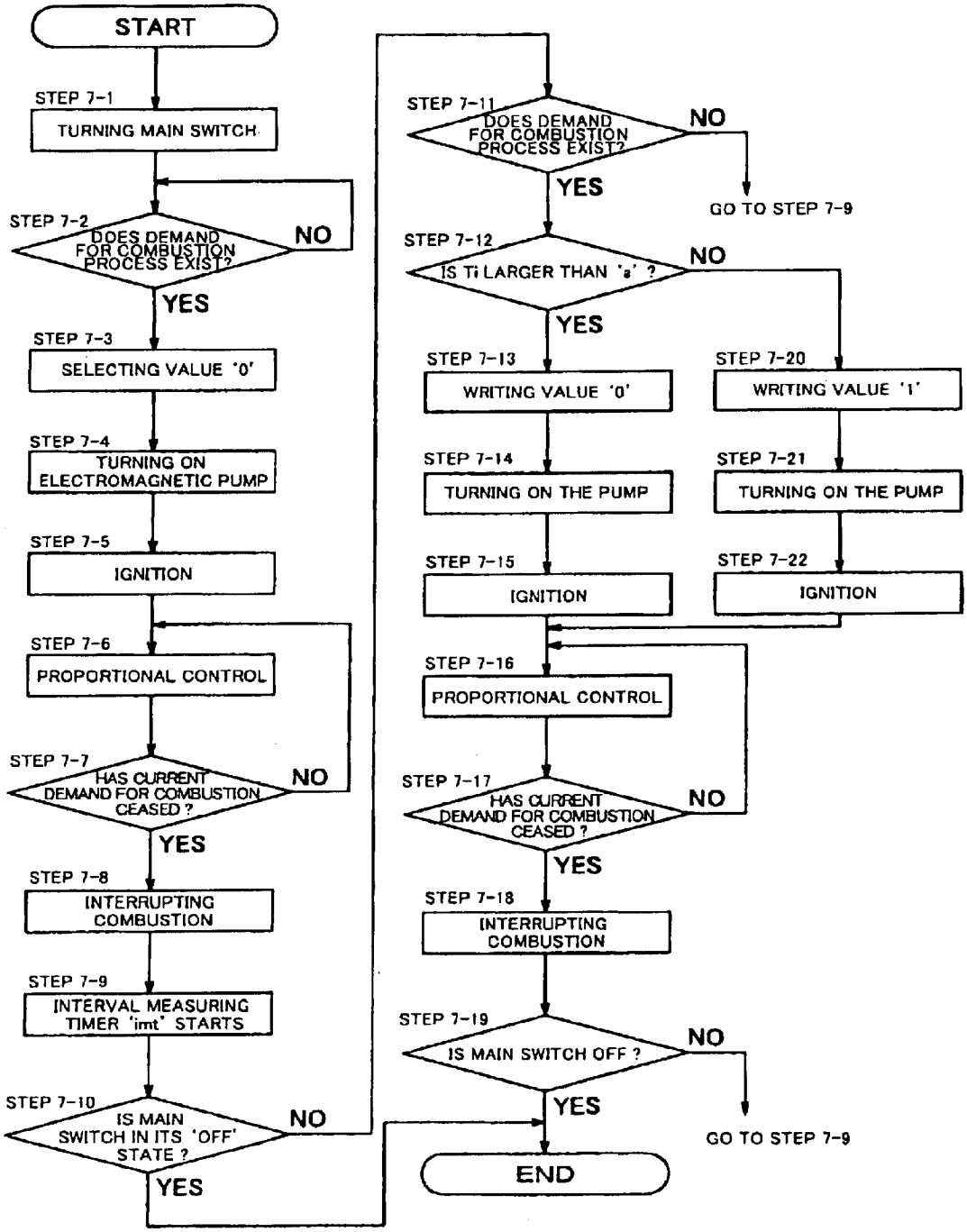

In the apparatus 2 of the present embodiment, the ignition control will be effected as seen in the flow chart of FIG. 7, only at the initial ignition step (viz., a first case) and in response to the delayed subsequent demand for combustion (viz., a second case). In the second case, as discussed above, the internal pressure of pump 18 is deemed to have lowered to an undesirable level, because the time lapse $T_i$ from the previous ignition and the subsequent demand for combustion is longer than a limit. Therefore, the spraying rate of fuel will be reduced to about 50–70% of that for the normal operation.

The fuel will thus be sprayed uniformly in the desired pattern even if the internal pressure of pump 18 is relatively low in this apparatus 2. The size of each mist particle is small enough to spread fire smooth-ly and rapidly throughout the mist stream, thereby avoiding misfire or incomplete combustion whenever starting a combustion process.

Even if such an initial ignition were not of a perfect nature, the reduced amount of initially fed fuel will produce merely a small quantity of soot and/or tar. Within a very short time after the initial ignition, the internal pressure of pump 18 will rise sufficiently to smoothly shift the combustion process to its normal phase. Such a reduced size of mist particles forming the desired pattern will surely burn the fuel whose flow rate satisfies the required amount of heat 'Q' to be generated.

As described above, the spraying rate can now be regulated to assume two phases taking into account the initial internal pressure of the pump 18, wherein one of the phases for a reduced flow rate of fuel does precede the other for a full flow rate. Frequent switching on and off of the combustion process will never cause any failure in ignition or any mal-ignition.

As also described above, each of the feed and return canals 16 and 17 leading to or extending back from the nozzle 12 is of a double-stop structure. The electromagnetic valve 20 and check valve 21 disposed downstreamly of pump 18 in the feed canal 16 are one set of double-stopping members. The check valve 23 and injector valve 25 disposed in the return canal 17 are the other set of double-stopping members. These members will contribute to perfect prevention of leakage of fuel into or out of the fuel tank 15.

However, the zone 'A' defined between the check valve 23 and the tightly closable injector valve 25 tends to show an extreme pressure, possibly injuring the check valve and/or injector valve. Therefore, the combustion apparatus 2 of this embodiment involves an accumulator 26 to buffer such an extreme pressure of the fuel having flown and is flowing through the canal 17. Thanks to this accumulator, the internal pressure in the zone 'A' will not usually rise so high as causing any damage on those valves 23 and 25.

Additionally to such an accumulator, the controller 40 will command an internal pressure control to be done for the fuel canals 13 in the apparatus 2 then standing inoperative. The internal pressure control is a generic term used herein to include a first, a second and a third types. The first type is an intermediate pressure relief carried out for protection of the valves 23 and 25, well after the interruption of a preceding combustion process but well before the resumption of a succeeding combustion process. The second type is a post-combustion pressure relief carried out just after the preceding process of combustion, and the third type is a pre-combustion pressure relief carried out just before the succeeding combustion process.

Figure 8:
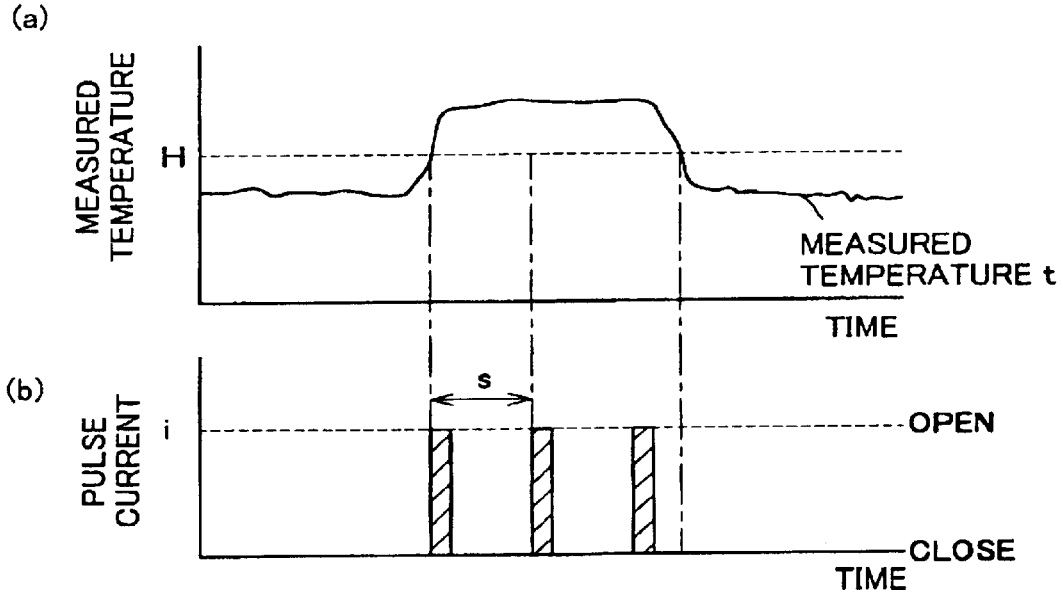
FIG. 8 is a pair of graphs (a) and (b), in which the graph (a) represents a sequence of data signals obtained by a temperature sensor installed in the apparatus of FIG. 1, with the graph (b) representing a sequence of the pulse signals output to the injector valve.
Figure 9:
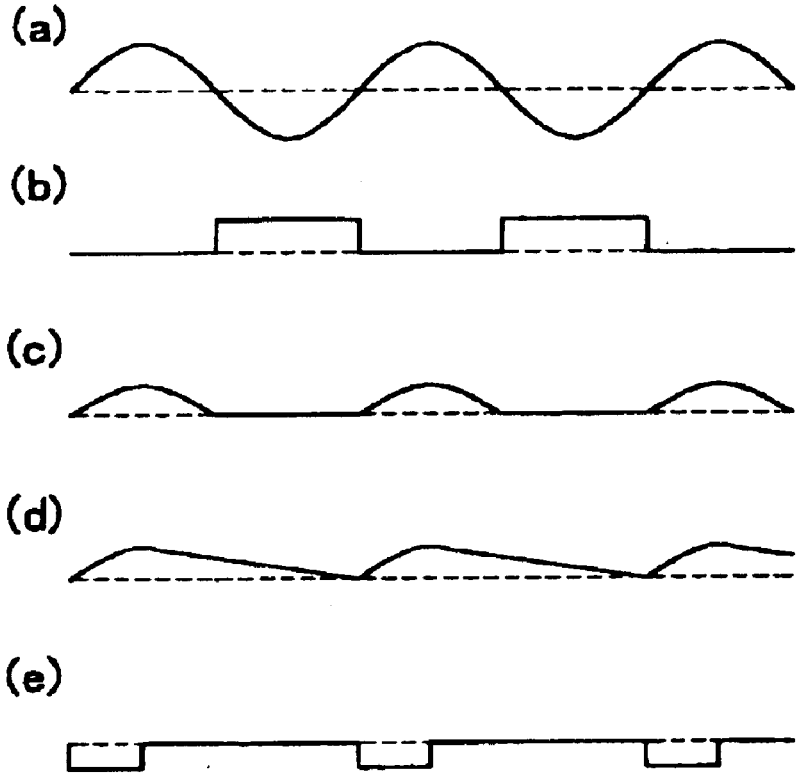
FIG. 9 is another array of graphs (a) to (e), that respectively correspond to those (a) to (e) included in FIG. 4.

In the valve-protecting intermediate pressure relief will be conducted by monitoring the temperature measured with use of the sensor 22 and temporarily opening and closing those valves 23 and 25. In detail, the sensor 22 will detect the temperature of fuel flowing through the return canal 17, as seen in FIG. 8. If the temperature rises above a limit 'H', then the controller 40 will apply a pulse current intermittently (at intervals of 's' seconds, in the embodiment). The valve body 33 of valve 25 thus repeats to open and be closed one, two or more times so as to intentionally leak the pressure out of the zone 'A'. Any latent or possible pressure rise due to a temperature rise in the resting apparatus will not actualize to damage these valves.

In a period immediately after termination of combustion in the preceding combustion process, the ambient air around the fuel canals 13 still remains hot causing a relatively high pressure of fuel then stagnant in the canals. Thus, if the injector valve 25 is closed within this period, then an extreme pressure would appear in the zone 'A' to impart such an extreme pressure to those valves 23 and 25. Therefore, the post-combustion pressure relief is designed to hold open the injector valve 25 for a predetermined time, for the purpose of lowering the internal pressure so as to protect those valves 23 and 25.

By virtue of such intermediate and post-combustion pressure relief steps, the internal pressure of canals 13 will generally be relatively low when starting thereafter the next combustion process. However, there is still a possibility that said pressure would eventually be high to an undesirable degree due to any unexpected causes. In such an event, the spraying pressure will pulsate, making unstable the combustion process. The controller 40 prescribes, as a consequence of such a consideration, the pre-combustion pressure relief to be done immediately prior to the presumption of the next combustion process. Thus, the intermittently operating valve 25 may be kept open for a predetermined time, in order to leak outwards the undesirably high internal pressure possibly appearing after the post-combustion pressure relief. Now, any change in ambient temperature or the like disturbance will not result in any undesirable high pressure that would otherwise affect adversely the smooth ignition and the non-pulsating combustion in the next process.

Either one or any two of these three types of pressure relief steps may suffice, though it is more preferable that all of them are done. In a case wherein both the post-combustion and pre-combustion pressure relief steps are involved, the latter step may be performed for a shorter time than the former step. This is because the internal pressure will not rise to any significant degree after the post-combustion and intermediate pressure relief steps will have been performed. Thus, such a shortened time for the pre-combustion pressure relief will not cause any trouble.

In this case, the next combustion process can be resumed smoothly and rapidly.

In the described embodiment, the periodic fluctuation of the pump's 18 internal pressure is represented with waves that show a certain phase shift relative to the current being supplied from the power source for driving the pump. Each wave in the pump pressure delays itself by the time 't' after the corresponding wave in the electric current. Therefore, in the described embodiment, the elapsed timer 'elt' is incorporated in the controller 40. However, there may be another case wherein the oscillating waves of pump pressure appear almost synchronously with the corresponding current waves. The timer 'elt' need not be installed in this case in the controller 40 that will execute successive steps shown in the flow chart of FIG. 10. This flow of controlling steps will not be detailed here, because it is almost the same as that shown in FIG. 6, except for the steps 6-4 and 6-5 omitted in this case.

Figure 11:
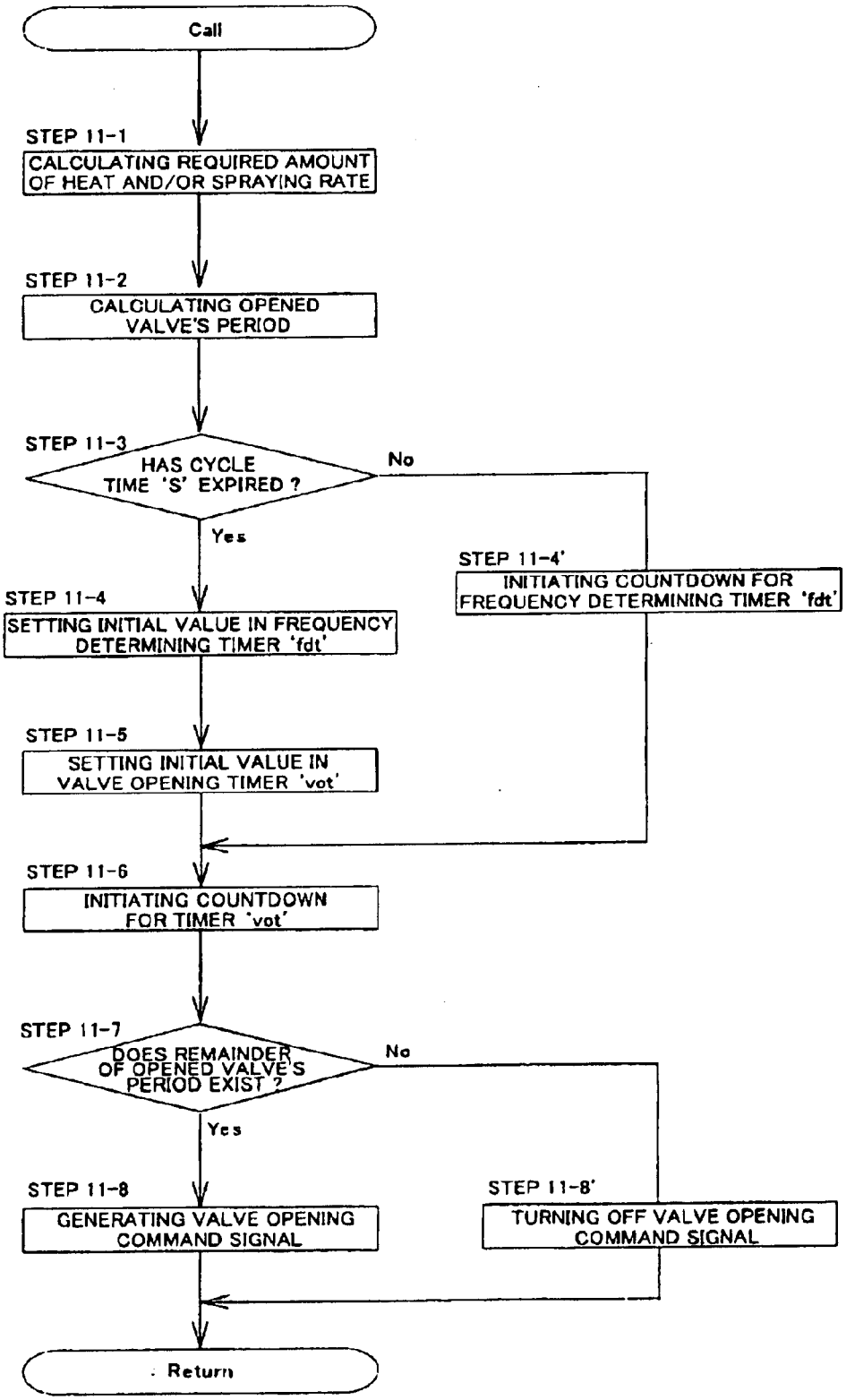
Figure 12:
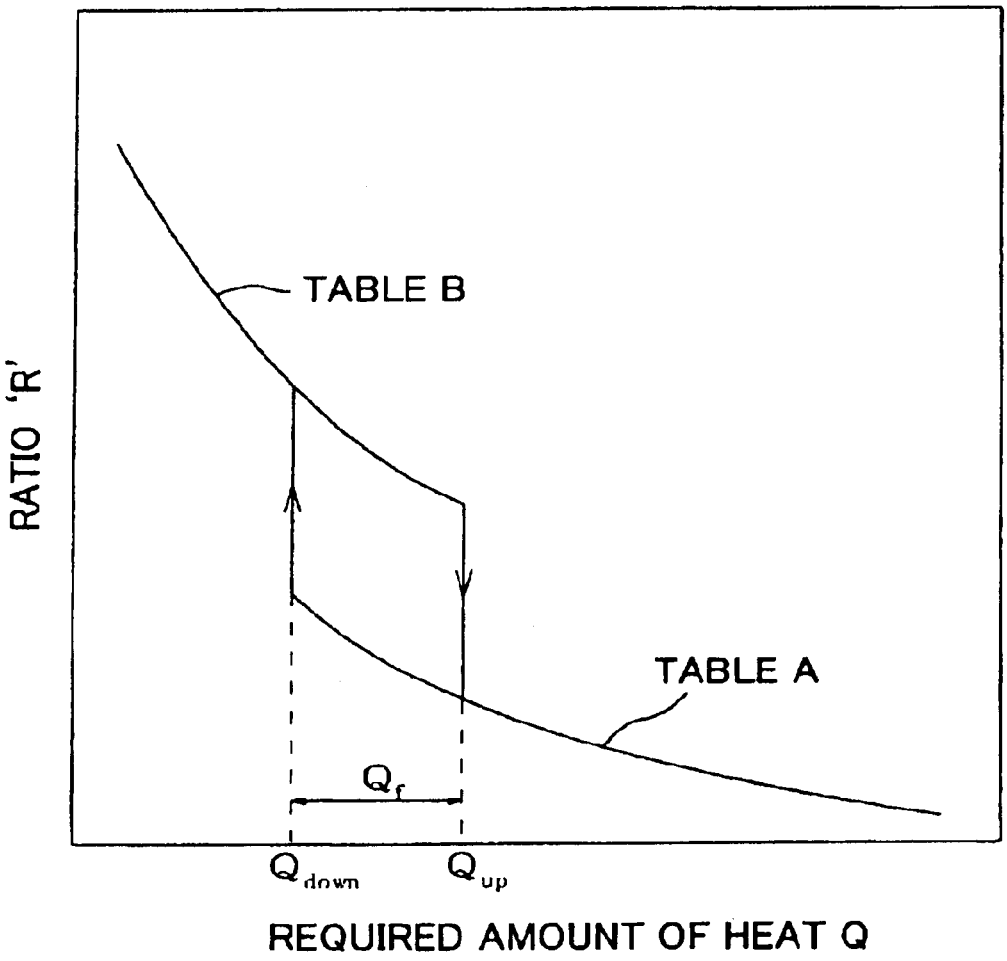
FIG. 12 is a graph showing the relationship designed between the "the "required amount of heat to be generated per unit time" and the "ratio of overall open time of the injector valve to a unit time"

The flow rate of fuel being burnt in the apparatus 2 may be controlled by repeating the opening and closing of the intermittently operating valve 25 by the valve body 33, according to a further alternative flow chart shown in FIG. 11. A frequency determining timer 'fdt' installed in the controller 40 in this case will determine a cycle time 'S' to correspond to the oscillographic wavelength of the current being supplied to pump 18. In this mode of control shown in FIG. 11, the opened-valve's period 'T' to be input to the valve-opening timer 'vot' will be determined by the duty ratio that is selected based on the required amount of heat to be generated per unit time.

As the apparatus 2 starts, a required amount of heat to be generated therein will be calculated at first at the step 11-1, in view of a target flow rate of the fuel to be burnt.

At the next step 11-2, the required amount of heat per unit time determined at the preceding step 11-1 will be utilized to calculate the opened-valve's period for the intermittently operating valve 25. At the succeeding step 11-3, a judgement will be done as to whether the cycle time 'S' has expired. If affirmative, then the process advances to the step 11-4 where an initial value will be set in the frequency determining timer 'fdt', before going to the next but one step 11-5 where an initial value is set in the valve opening timer 'vot'. On the other hand, if the answer to the judgement at step 11-3 is negative so as to indicate that there is found the remainder more or less, then the process will make a bypass to the step 11-4' to initiate countdown for frequency determining timer 'fdt'.

The process will go to step 11-6, through the step 11-5 or 11-4', so as to begin countdown for the valve opening timer 'vot'. A further judgment will be done at step 11-7 as to whether the remainder 'T'' of the opened valve's period 'T' exists. If the answer is positive to this judgment, indicating that a certain remainder is present in the opened valve's period 'T', then a valve opening command signal will be generated at step 11-8 to apply a pulse current to the electromagnetic coil 32 in injector valve 25, thereby opening its valve body 33. If the answer to judgment at step 11-7 is negative indicating that no remainder is found in the opened valve's period 'T', then the process bypasses to step 11-8' where the valve opening command signal will be turned off to close the valve body 33.

Figure 6:
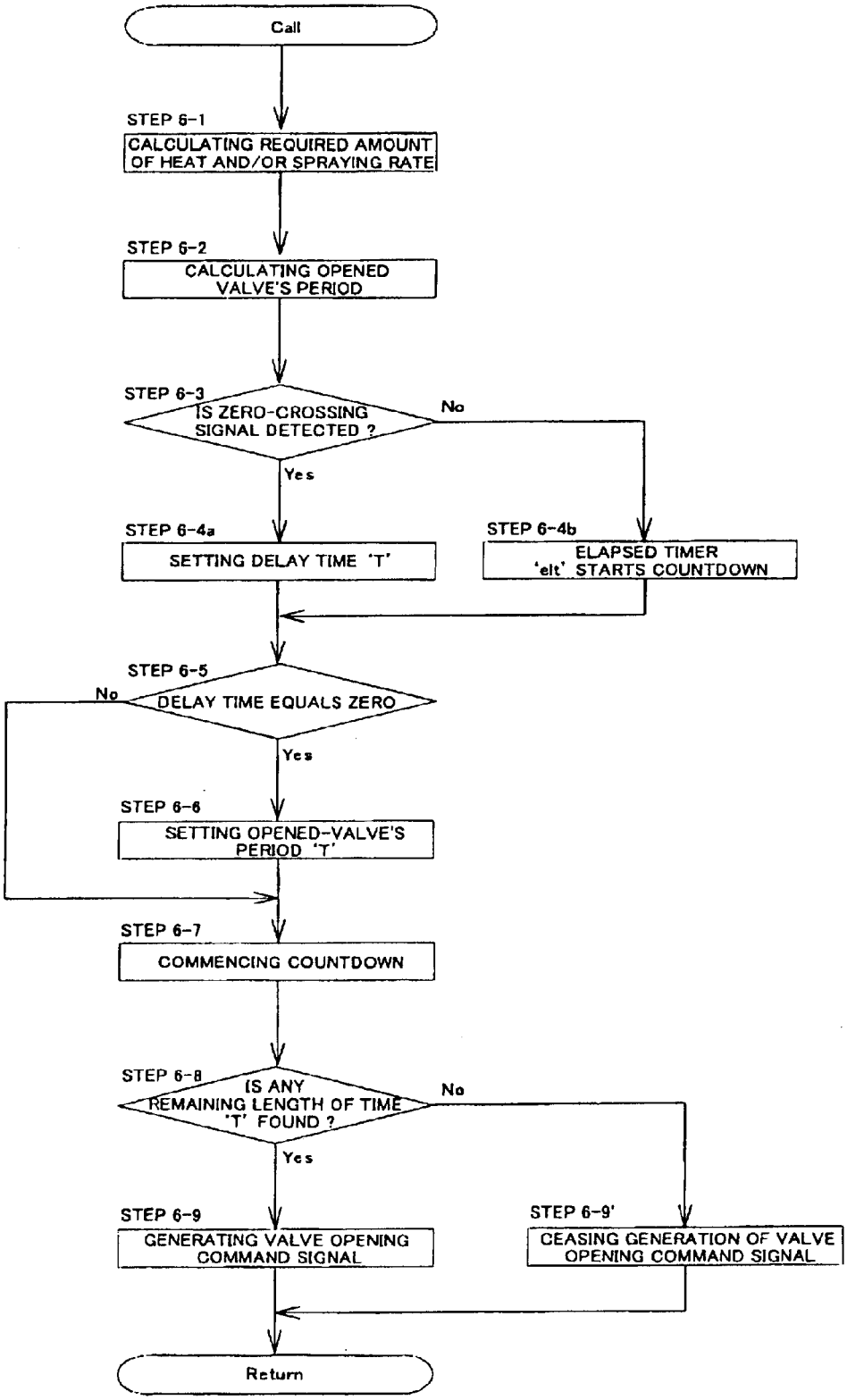
FIGS. 6 and 7 are flow charts of an operational mode of the combustion apparatus shown in FIG. 1 and driven by the data processing shown in these figures.
Figure 10:
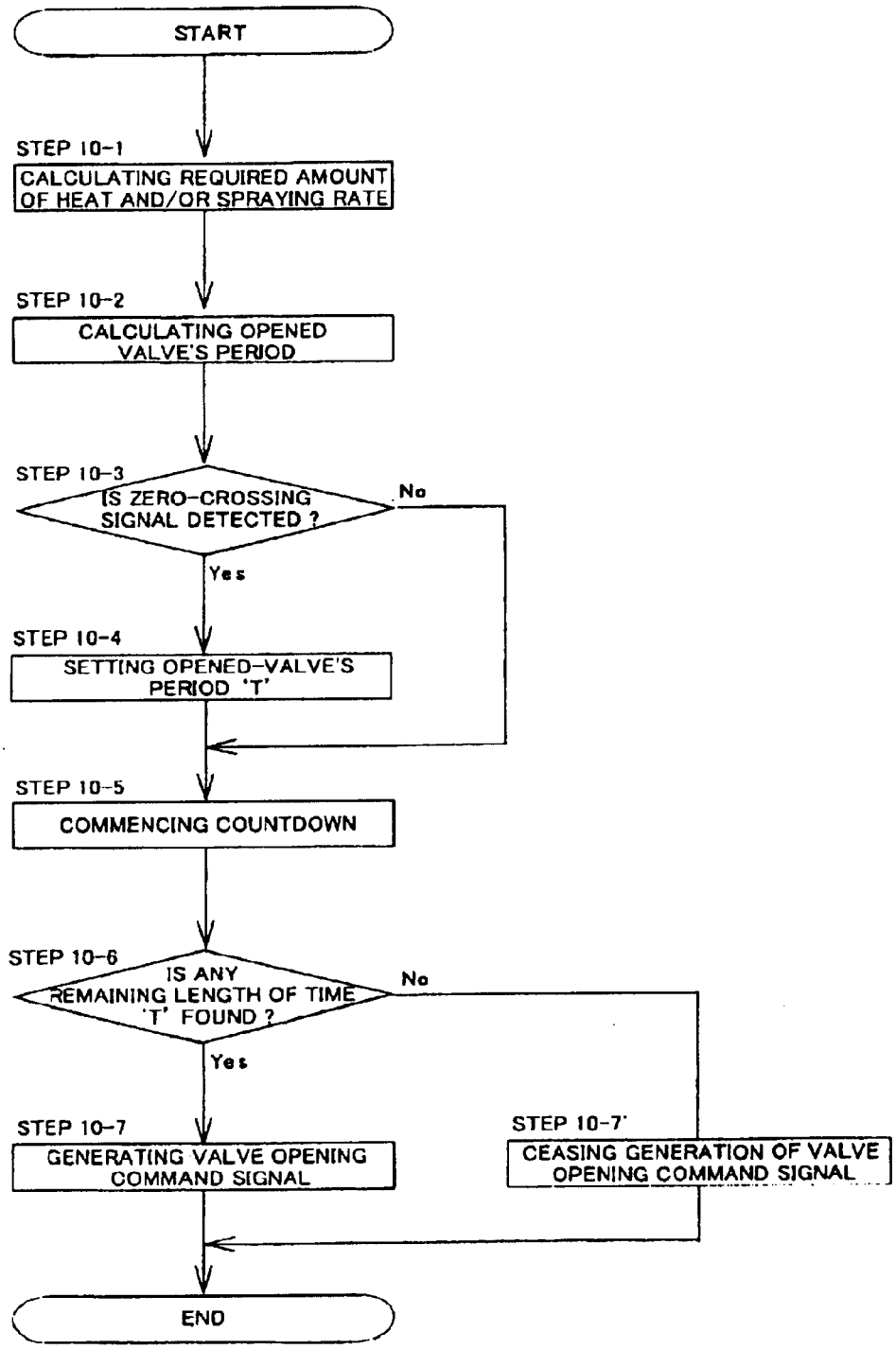
FIGS. 10 and 11 are further flow charts of a modified operational mode of the combustion apparatus shown in FIG. 1 and driven by the data processing shown in these figures.

The programs shown in FIGS. 6, 10 and 11 are each useful to properly control the operation of injector valve 25 so as to stabilize the sprayed rate of fuel. This valve in the apparatus 2 will however make a noise, due to the opening and closing of its valve body 33. Such a valve's noise would be offensive to the ears, unless the decibel level of background noise inherent in combustion process itself is considerably high, for example, in the case the required amount of heat is relatively large.

Figure 15:
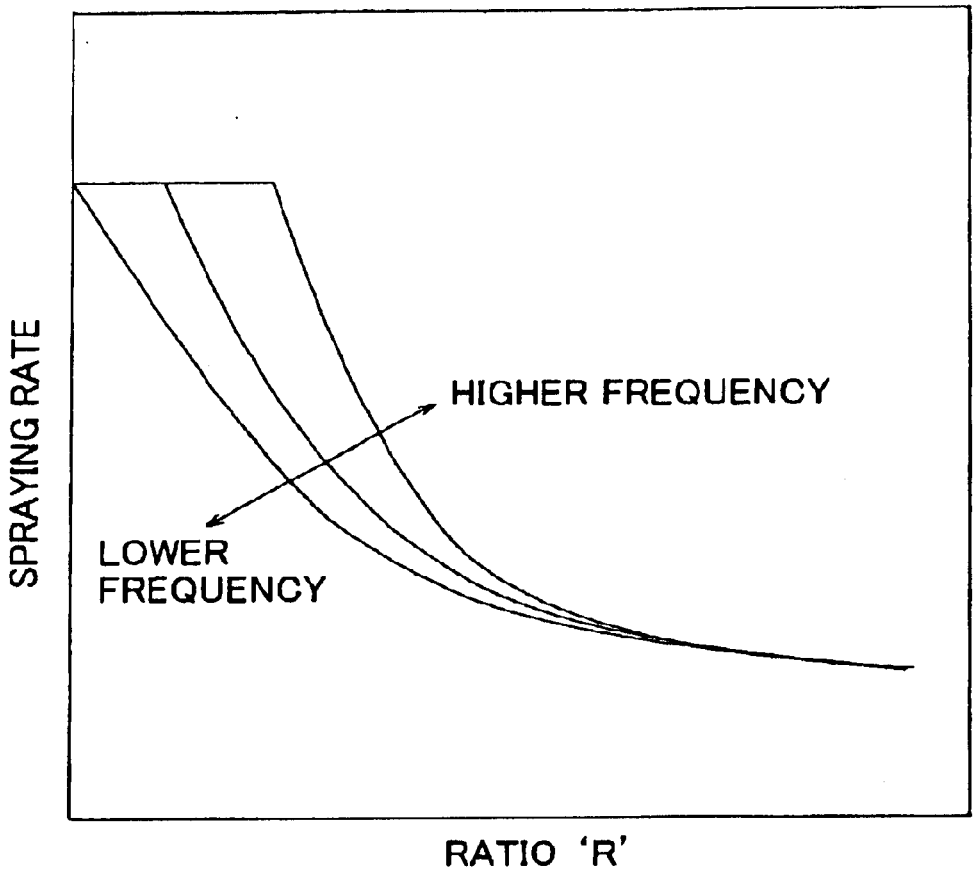
FIG. 15 is a graph showing the relationship designed between the flow rate of fuel being sprayed and the ratio of overall open time of the injector valve to a unit time.
Figure 16:
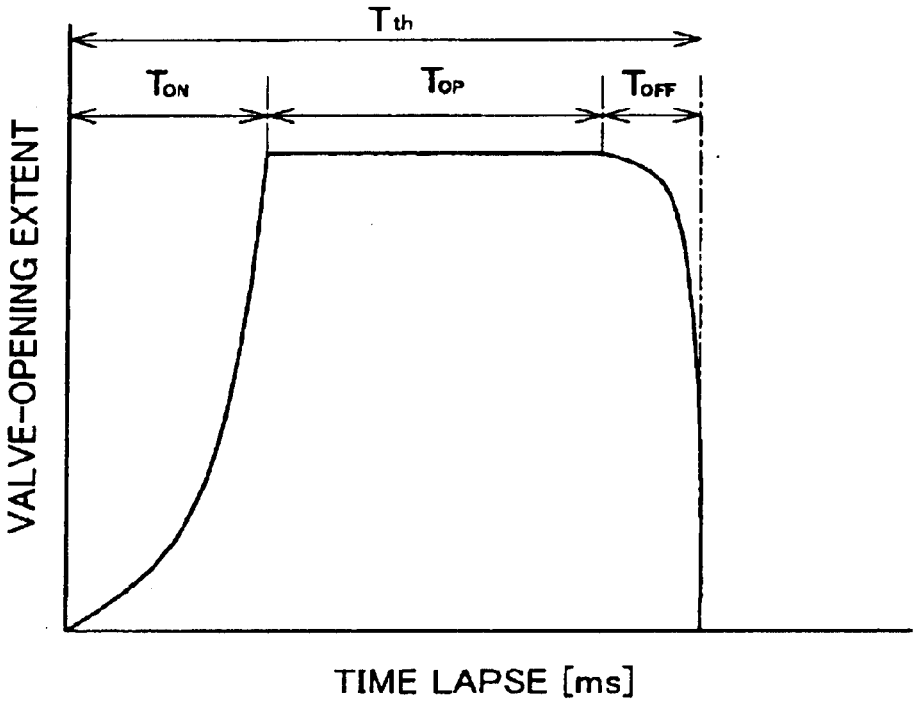
FIG. 16 is a further graph showing the relationship found between the time lapse of the injector valve held in its ON state and the extent to which this valve is opened.

FIG. 15 is a graph showing an exponential relationship that is observed between (i) the ratio 'R' of the valve's 25 opened period included in a unit time to the length thereof and (ii) the flow rate of fuel actually sprayed out from the nozzle 12. As will be seen in this graph, lower frequencies at which this valve repeats to open and be close will reduce the actual spraying rate beyond an expected value. If however the required amount of heat 'Q' and amount of fuel to be sprayed is considerably low, then any actual flow rate will coincide with the expected value, whether the frequency is high or low. In consideration of these facts, a controller 45 may be employed in place of the described one 40. This will be effective to reduce the noise level of pump 25 without bringing about any unstable combustion of fuel.

The controller 45 used in this embodiment will perform an ignition control and an internal pressure control in the same manner as the described one 40 so does. However, the combustion control done by this controller 45 differs from that done by the described one 40. In detail, this controller 45 includes a CPU not shown but executing a duty-ratio control on the whole one-cycle period 'L' and opened-valve's period 'T' in the period 'L' of the opening-and-closing motions of valve body 33. This control does also relate to the infinitesimal, or considerably short, period of opened valve body in each cycle of said motion. One of the processing registers and the like installed in the CPU is a valve opening timer 'vot' that will incrementally count (down) the opened-valve periods $t_A$ and $t_B$. These periods $t_A$ and $t_B$ will have been determined based on the ratio 'R' of the valve's 25 opened period.

Also installed in the controller 45 are a table-A and a table-B that define the relationship between the said ratio 'R' and the required amount of heat 'Q'. The table-A applies to the values of 'Q' that are equal to or higher than a limit included in a boundary zone $Q_f$, and the other table-B applies to other values of 'Q' lower than another limit also included in this zone $Q_f$. In other words, the table-A and the table-B correspond to "hypothetical regions" of control. These regions have different frequencies of the duty-ratio control in relation to the required amount of heat to be generated per unit time.

In other words, the first limit to be applied to a first case of the required amount of heat 'Q' increasing does differ from the second limit applied to a second case of this amount 'Q' decreasing. Such a difference between the limits results from a hysteresis observed in the apparatus 2 between the required flow rate of fuel to be burnt and opened-valve's period 'T'. The first limit is an upper end $Q_{up}$ of the zone $Q_f$, and the second limit is a lower end $Q_{down}$ of this zone, respectively corresponding to the first and second cases just noted above.

The frequencies $L_A$ prescribed in the table-A for the opening-and-closing motions of valve body 33 are higher than those $L_B$ in the table-B. Thus, one cycle time corresponding to each frequency listed in table-A and within the zone $Q_f$ is for example a half of that corresponding to the same frequency in table-B and within this zone $Q_f$. The controller 45 will select table-A or table-B, in response to the change in current level of 'Q', to thereby use appropriate ratios 'R' of the opened-valve's periods to the unit time.

The controller 45 will thus supply a pulse current synchronous with the power source for pump 18 so as to drive the injector valve to be opened and closed repeatedly. The pulse current will now be detailed below.

Figure 13:
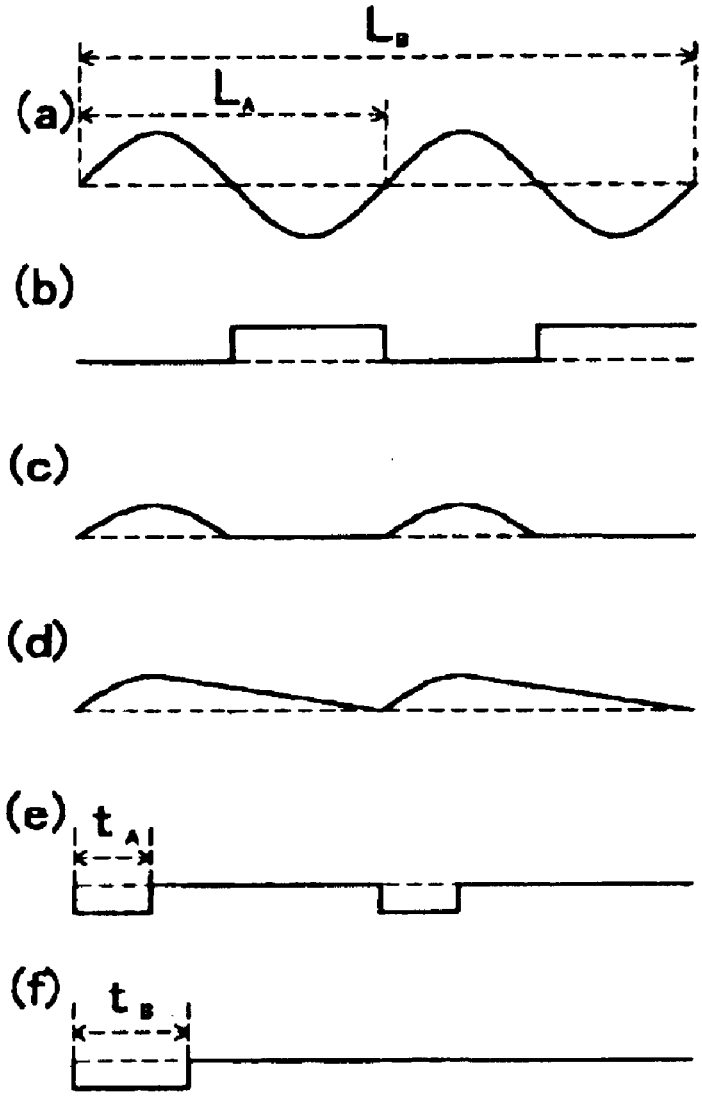
FIG. 13 is still another array of graphs (a) to (f), with (a) to (e) corresponding respectively to those (a) to (e) included in FIG. 4.

The electromagnetic pump 18 is driven with a rectified current of FIG. 13(*c*), that is produced from an alternating current periodically altering its phase as shown in FIG. 13(*a*). This pump will thus show a fuel discharging pressure that varies in the course of time, following the periodic phase shift in the power source as shown in FIG. 13(*d*). The controller 45 detects every point where the intensity of current will become null, thereby producing a series of zero-crossing signals shown in FIG. 13(*b*).

The controller 45 will select either the table-A or the table-B, based on the current level of the required amount of heat 'Q'. The table-A will be employed in a case wherein 'Q' is found equal to or higher than the limit $Q_{up}$ or $Q_{down}$. In this case, a frequency $L_A$ makes the duty control show one cycle time equal to one cycle time of the alternating current. Based on this cycle time corresponding to the frequency $L_A$ and the current ratio 'R' of the opened-valve's period, the time length $t_A$ of every pulse to be generated is determined. In detail, the controller 45 will multiply $L_A$ by 'R' to determine $t_A$ so as to generate a pulse of this length $t_A$ starting upon detection of the trailing edge of zero-crossing signal as shown in FIG. 13(*e*).

However, the other table-B will be employed if 'Q' is lower than the limit $Q_{down}$ or $Q_{up}$. In this case, another frequency $L_B$ makes the duty control show one cycle time equal to two cycle times of the alternating current. Based on this cycle time corresponding to frequency $L_B$ and the current ratio 'R' of the opened-valve's period, the time length $t_B$ of every pulse to be generated is determined. In detail, the controller 45 will multiply $L_B$ by 'R' to determine $t_B$ so as to generate a pulse of this length $t_B$ also starting upon detection of the trailing edge of zero-crossing signal in a manner as shown in FIG. 13(*f*).

Selection of one of the table-A and table-B is thus made referring to the limits $Q_{up}$ and $Q_{down}$ serving as criteria, and based on whether the required amount of heat 'Q' is then increasing or decreasing. If 'Q' is increasing, then it will be compared with $Q_{up}$ to select table-A or table-B. If Q' is decreasing, then it will be compared with $Q_{down}$ also to select table-A or table-B.

The duty-ratio control executed in and by the controller 45 does rely on the frequencies $L_A$ and $L_B$ of duty-ratio control steps, as well as on the time lengths $t_A$ and $t_B$ of every pulse of the valve opening signals. The timings at which the valve body 33 opens and closes the channel will be kept synchronous with the power source frequency for the pump 18, but the frequency of opening and closing of this valve body 33 will be altered by changing the frequencies $L_A$ or $L_B$. Thus, in a case wherein 'Q' is lower than the limit, the number of times of opening and closing of the valve body 33 will be reduced to diminish a noise emitted therefrom.

Figure 14:
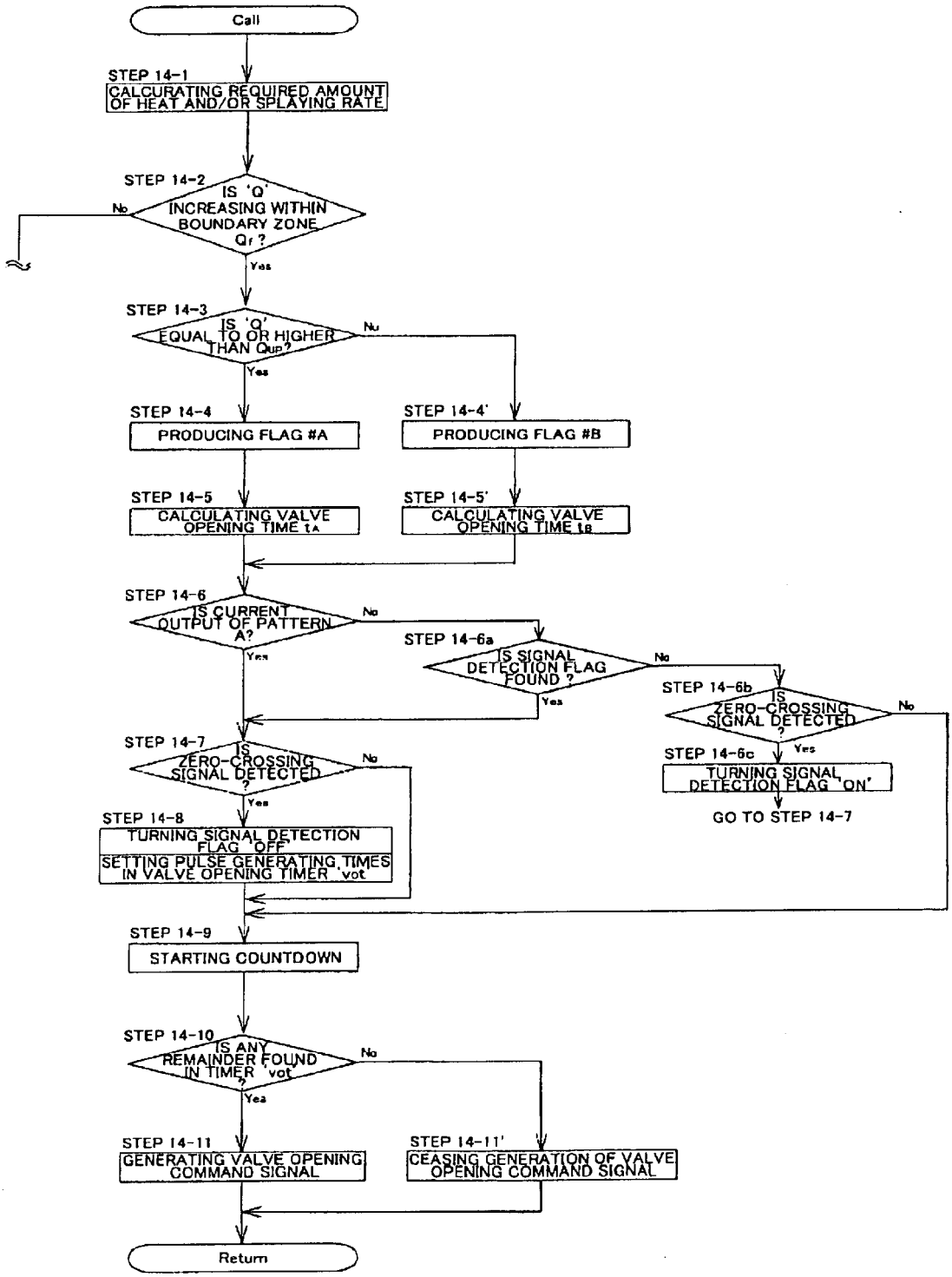
FIG. 14 is still another flow chart of a further modified operational mode of the combustion apparatus shown in FIG. 1 and driven by the data processing shown in this figure.

The controller 45 will function to drive the combustion apparatus 2 in a manner as will be seen in the flow chart of FIG. 14. As this apparatus starts to operate, a required amount of heat 'Q' is calculated at the step 14-1, in view of a target flow rate of the fuel to be burnt. How this amount 'Q' is varying currently will be judged then, in detail making a judgment at step 14-2 as to whether it is increasing within the boundary zone $Q_f$. If affirmative, then the process advances to step 14-3. If negative to indicate that 'Q' is decreasing or out of the zone $Q_f$, then the opened-valve's period and other conditions will be controlled as will be described below.

Made at step 14-3 is another judgment as to whether 'Q' is equal to or higher than $Q_{up}$. If affirmative, then the process goes to step 14-4 where a flag #A indicating a pattern-A output of the apparatus 2 will be produced. At the next step 14-5, the value 'Q' and table-A that has been written in the controller 45 are used to calculate the valve opening time $t_A$, before going to step 14-6.

If the result of judgement made at step 14-3 is negative, then another flag #B indicating a pattern-B output of the apparatus will be produced at step 14-4', before going to step 14-5'. In a case wherein 'Q' is lower than $Q_{up}$, valve's noise caused by its opening and closing motions may be offensive to the ears in contrast with the normal combustion noise. Therefore, the frequency of duty-ratio control will be reduced to a half of that employed in the former case of 'Q' higher than $Q_{up}$. This means that the one cycle time of duty-ratio control is rendered twice as long as that applied to said former case. At the next step 14-5', the value 'Q' and table-B previously written in the controller are used to calculate the valve opening time $t_B$, before advancing to step 14-6.

Made at this step 14-6 is a judgment as to whether the current output of apparatus 2 is of the pattern-A or pattern-B. One cycle time of the duty-ratio control for pattern-A is decided by the frequency $L_A$ to be equal to one cycle of the alternating current from power source. One cycle time for pattern-B is decided by the frequency $L_B$ to be twice as long as the one cycle of the alternating current. Every zero-crossing signal detected during operation of the pattern-A activates the injector valve 25, whereas every couple of said successive signals activate this valve during operation of Pattern-B. With the pattern-A being detected at step 14-6, the process advances to step 14-7 where a zero-crossing signal will be received before going to step 14-8. A signal detection flag will be turned OFF at this step, making the valve 25 ready for its opening and closing motions. If the pattern-B is detected at step 14-6, the process will advance through the steps 14-6*a*, 14-6*b*, 14-6*c* and 14-7 in order to detect the second one of two successive zero-crossing signals before going to step 14-8.

In detail, if the signal detection flag is found ON at step 14-6*a*, then the process goes to step 14-7 for detection of the sole or second zero-crossing signal. If however this flag is found OFF at step 14-6*a*, then the process will be made ready for detection of the first zero-crossing signal at step 146*b*.

If no such first signal is detected at this step 14-6*b*, the process will skip to step 14-9. If the first signal is detected at step 14-6*b*, then the process advances to step 14-6*c* to turn the signal detection flag ON, before going to step 14-7 where the second signal will be sensed.

Upon detection of zero-crossing signal at step 14-7, a pulse generating time that is $t_A$ for the output pattern-A, or $t_B$ for pattern-B, will be set in the valve opening timer 'vot' at step 14-8. If no zero-crossing signal is detected at step 14-7, the process will skip to step 14-9.

Countdown will be started from the time $t_A$ or $t_B$ at this step 14-9. If any remainder is found in the time $t_A$ or $t_B$ at the next step 14-10, then a valve opening command will be output at step 14-11. Thus, the coil 32 will electrically be activated to open the valve body 33 in injector valve 25, before returning to the first step 14-1. If no remainder is found in the time $t_A$ Or $t_B$ at step 14-10, then the valve opening command will no longer be generated, thereby inactivating the coil 32 to close valve body 33.

If the required amount of heat 'Q' is found in the boundary zone $Q_f$ but decreasing therein, then control will be carried out to follow the steps 14-3 to 14-11. This mode of control is almost the same as that in first case wherein 'Q' is increasing, except for the judgment being done to compare 'Q' with the limit $Q_{down}$ at step 14-3. Therefore, details of this mode will neither be described nor shown in the drawings.

If the required amount of heat 'Q' is not found in the boundary zone $Q_f$, then the process started at step 14-1 will skip either to step 14-4 for the amount of heat 'Q' being equal to or higher than $Q_{up}$, or to step 14-4' for the amount of heat lower than $Q_{down}$.

It will now be apparent that the controller 45 has to select the table-A if the output from apparatus is of the pattern-A, indicating that 'Q' is equal to or higher than the limit $Q_{up}$ or $Q_{down}$. In this case, the frequency $L_A$ makes the duty control show one cycle time equal to one cycle time of the alternating current from power source. Thus, the injector valve 25 is caused to be opened and closed at the same frequency as and synchronously with the alternating current driving the pump 18, without pulsating inside the return canal 17. The ratio 'R' of remainder time in the opened-valve's period will be calculated using the required amount of heat 'Q' and also the content of table-A, so as to determine the valve opening time $t_A$. Fluctuation in pressure will negligibly be small even if it would appear in the fuel stream moving towards the nozzle 12, so that fuel is sprayed constantly to ensure stable combustion at a remarkably lowered level of noise.

It will also be apparent that the controller 45 has to select the table-B if the output from the apparatus is of the pattern-B, indicating that 'Q' is lower than the limit $Q_{up}$ and $Q_{down}$. In this case, the frequency $L_B$ makes the duty control show one cycle time equal to the sum of two cycle times of the alternating current from power source. Thus, the system will now open and close the injector valve 25 at a frequency lowered to a middle height of that applied to the former case of the higher value of 'Q'. By virtue of such a reduced number of times of opening and closing the valve, a somewhat metallic noise caused for instance by collision of the valve body 33 with the casing 30 will be lowered to a half intensity that may be drowned out by combustion noise.

The control mode just detailed above is characterized in that the frequency of duty-ratio control is lowered to decrease the number of times to open and close the injector valve, only if the required amount of heat 'Q' is below the boundary zone $Q_f$. FIG. 15 shows that the lower the target flow rate 'R' is, the less the difference in frequency of duty control will affect the actual flow rate, enabling the control mode discussed above.

It will also be apparent that the controller 45 has to select the table-B if 'Q' is lower than $Q_{up}$ and $Q_{down}$. The ratio 'R' of remainder time in the opened-valve's period will be calculated using the required amount of heat 'Q' and also the content of table-B, so as to determine the valve opening time $t_B$. The injector valve 25 is caused to be opened and closed at the same frequency as and synchronously with the alternating current driving the pump 18, without pulsating inside the return canal 17. Fluctuation in pressure will negligibly be small even if it would appear in the fuel stream moving towards the nozzle 12, so that fuel is sprayed at a constant pressure to ensure stable combustion.

The discharging pressure of electromagnetic pump 18 changes its level very rapidly and instantly without any delay and in response to the repeated shift in phase of the alternating current from power source. Therefore in some cases proposed herein, a pulse current for driving the pump is applied to the terminal 38 upon detection of every zero-crossing signal in said alternating current. However, there may be another case wherein a certain delay is observed between the phase shift in the alternating current and the sequential change in the pump's discharging pressure in the course of time, as shown in FIG. 4. In this case, it is preferable to apply the pulse current for driving the pump to the terminal 38 after a proper delay of time after detection of every zero-crossing signal in said alternating current. Pressure fluctuation of the fuel being fed to the nozzle 12 will be suppressed to stabilize combustion.

The injector valve 25 employed in the described embodiments has its valve body 33 capable of making strokes fore and aft in an instant. As compared with the proportional control valves, the injector valve 25 is extremely advantageous to enhance accuracy in controlling the flow rate of fuel. The valve body 33 is driven very quickly by an electromagnetic mechanism to open in an instant $t_{ON}$ and be closed in another instant $t_{OFF}$. Generally, these instants $t_{ON}$ and $t_{OFF}$ are much shorter than a period $t_{OP}$ in which the valve body 33 will be kept full open. The flow rate of the fuel moving fast through this valve 25 will scarcely be affected by such glancing instants $t_{ON}$ and $t_{OFF}$.

Length of each instant $t_{ON}$ and $t_{OFF}$ depends on the mechanical properties of the injector valve 25, thus not showing any significant fluctuation extent following any usual or moderate change in duty ratio thereof. However, if an extremely high amount 'Q' is required in the combustion process using the apparatus 2, the valve 25 will have to operate with an infinitesimal duty ratio. In such a case, the proportion of those instants $t_{ON}$ and $t_{OFF}$ in the full open period $t_{OP}$ or a theoretical period $t_{th}$ of the open state of valve 25 will not be of any negligible order.

On the other hand, ambient temperature may occasionally rise to a noticeable degree due to violent combustion in the apparatus, thereby heating the fuel then flowing through the canals 13. The fuel in these canals will consequently show such an undesirably low viscosity that it tends to make a more turbulent swirling motion within the fuel spraying nozzle 12. As a result, an apparent resistance of the inner surface of spray mouth against the flow of fuel will increase, so that an excessive portion of the fuel will make a U-turn into the return canal 17 to thereby decrease an actually sprayed rate of the fuel.

In view of such a latent problem, another controller 46 may substitute for that 40 already detailed hereinbefore.

A pulse current 'i' synchronized with the alternating current being supplied to the electromagnetic pump 18 will be applied to the coil 32 of injector valve 25, similarly to the case of using the first-described controller 40. However, the controller 46 of the present embodiment will detect every zero-crossing point in the alternating current driving the valve body 33, as shown in FIG. 4(*b*).

Also, this controller 46 will determine at first a duty ratio 'r' based on the required amount of heat 'Q' of fuel to be burnt in the apparatus 2. Unlike the first-described controller 40, the present controller 46 will modify from time to time the unit time of every duty ratio control. This modification may be done referring to the temperature 'k' detected by the sensor 22 disposed in return canal 17, or referring to the required amount of heat 'Q'. In detail, frequency of the current activating the coil 32 to open and close the valve 25 will be adjusted in view of 'k' or 'Q'.

If the detected temperature 'k' is equal to or lower than a critical temperature 'K', then the frequency $f_1$ of the current for coil 32 will be set equal to that $L_1$ of the alternating current driving the pump 18. Thus, one cycle time length for $f_1$ will be made the same as that for that $L_1$. If contrarily 'k' is higher than 'K', then the frequency $f_2$ of the current for coil 32 in this case will be set to be a half of $f_1$ (viz., $f_2=f_1/2$). The one cycle time length for $f_2$ will be made twice as long as that for $L_1$ (in other words, $L_2=2L_1$, where said length are denoted with the symbol 'L').

If the required amount of heat 'Q' is equal to or lower than a critical amount of heat $Q_b$, then the frequency $f_1$ of the current for coil 32 will be set equal to that $L_1$ of the alternating current driving the pump 18. Thus, one cycle time length for $f_1$ will be made the same as that for that $L_1$. If contrarily 'Q' is higher than $Q_b$, then the frequency $f_2$ of the current for coil 32 in this case will be set to be a half of $f_1$ (viz., $f_2=f_1/2$). The one cycle time length for $f_2$ will be made twice as long as that for $f_2$ (in other words, $L_2=2L_1$, where said length are denoted with the symbol 'L').

The present controller 46 will determine the theoretical open period $t_{th}$ based on the frequencies or wavelengths $L_1$ and $L_2$ and the duty ratio 'r'. The controller 46 multiplies $L_1$ and $L_2$ by 'r' to obtain the valve opening times $t_1$ and $t_2$, respectively. If the detected fuel temperature 'k' is not higher than 'K', or the required amount of heat 'Q' is not higher than $Q_b$, then a pulse current 'i' will be input to the terminal 38 for a time $t_1$ upon detection of a trailing edge of every pulse of the zero-crossing signal. Thus, in a case wherein the opened-valve's period per unit time of valve 25 is longer than a threshold so as to be smoothly and surely opened and closed, the higher frequency $f_1$ will be adopted.

If contrarily the detected fuel temperature 'k' is higher than 'K', or the required amount of heat 'Q' is higher than $Q_b$, then the pulse current 'i' will be input to the terminal 38 for a time $t_2$ that is twice as long as the time $t_1$, upon detection of the trailing edge of every pulse of the zero-crossing signal. Thus, in this case wherein the opened-valve's period per unit time of valve 25 is shorter than the threshold, failing to be smoothly and surely opened and closed, the lower frequency $f_2$ will be adopted to avoid any unreliable opening and closing motion of the valve 25 and also to avoid any unstable spraying of the fuel.

Figure 17:
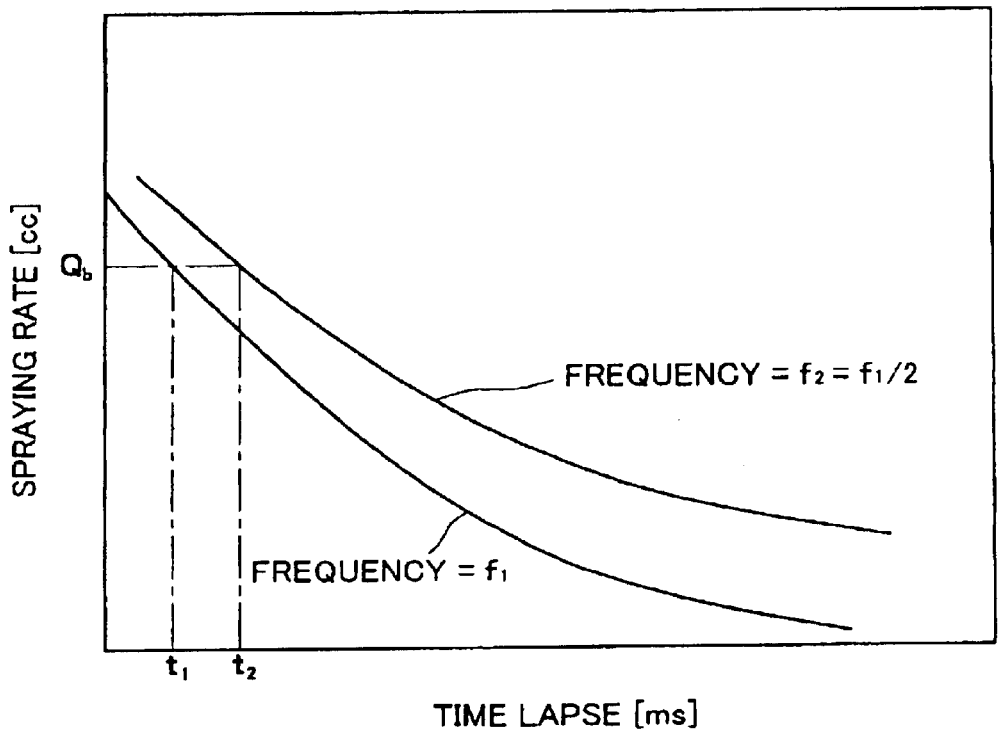
FIG. 17 is a still further graph showing the relationship found between the time lapse of the injector valve held in its ON state and the flow rate of the fuel being sprayed.
Figure 18:
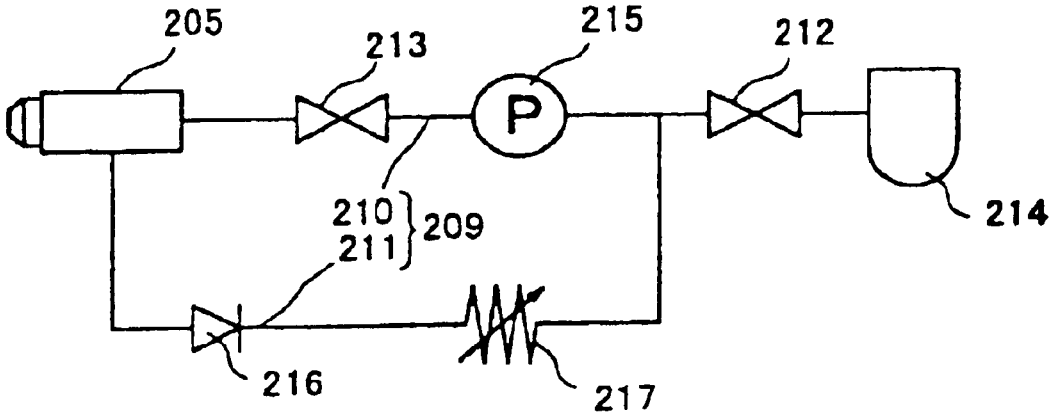
Fig. 18 (PRIOR ART)
FIG. 18 is a diagram showing a fuel pipe line in the related art combustion apparatus.
Figure 19:
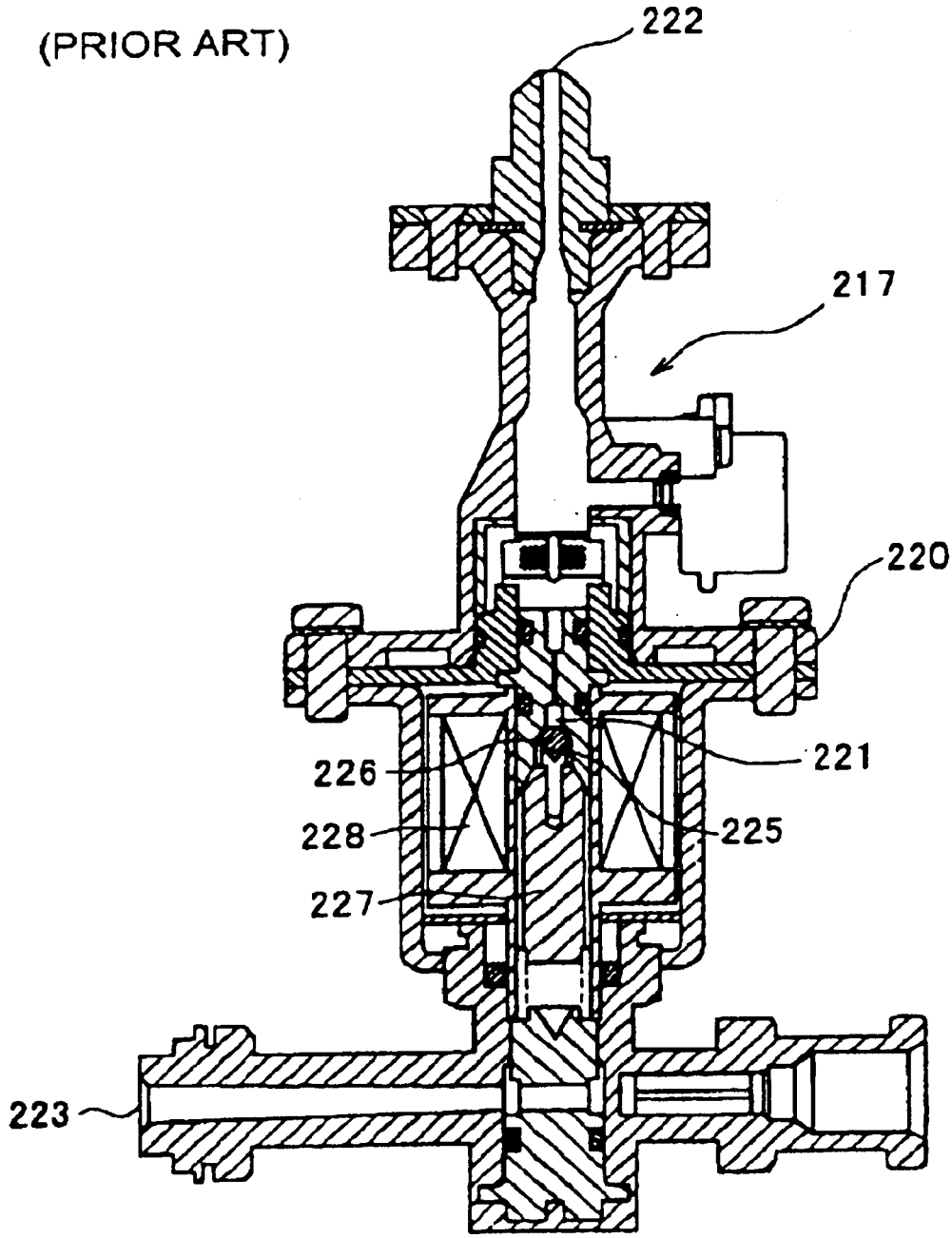
Fig. 19 (PRIOR ART)
FIG. 19 is a cross section of a proportional control valve employed in the related art apparatus.

As discussed above, if 'k' is higher than 'K' or 'Q' is so higher than $Q_b$ as minimizing the duty ratio 'r', then the injector valve 25 is allowed to reciprocate between its open and closed positions within a longer time $t_2$ that is about twice as long as the time $t_1$ to be sufficiently longer than same as shown in FIG. 17. In this way, the times $t_{ON}$ and $t_{OFF}$ for opening or closing the valve 25 are rendered negligible relative to the theoretical period $t_{th}$ thereof in open state. Neither any considerably short period $t_{th}$, nor any remarkably high temperature of fuel flowing through the canals 13, will any longer make it difficult for the nozzle 12 to smoothly and constantly spray the fuel.

The controller 40 detailed hereinbefore relies on the time intervals T" at which the demand for fuel combustion is repeated, in order to judge the smoothness and stability of the spraying of fuel. In other words, the controller 40 deems the spraying pressure, i.e., the internal pressure of pump 18 to be an important factor. This pressure varying in the course of time is thus regarded as a function of T" so that the flow rate of fuel being compressed towards and sprayed out of the nozzle 12 is regulated referring to these time intervals. The present invention is not delimited to such a mode of control, but may be modified in any manner. For example, a pressure sensor may be employed to directly detect the pressure of fuel being sprayed, or a temperature sensor 22 disposed in return canal 17 may be used to indirectly judge such a pressure of fuel being sprayed. The fuel spraying rate will be controlled based on such direct or indirect data obtained in said manners.

The controller 40 in the first-described embodiment is able to conduct the ignition control by regulating the duty ratio 'r' of injector valve 25. In such a mode, the duty ratio is adjusted based on the internal pressure of pump 18 so as to ensure the fuel spraying generally of a desired pattern. The controller 40 of the invention may not necessarily be restricted to this mode of ignition control. It can be modified to change the number of rotations of the fan or blower 11 per unit time, also in response to the current internal pressure appearing in the electromagnetic pump 18.

The internal pressure of pump 18 is prone to descend in the course of time after the preceding termination of combustion until the next ignition. In a case of resumption done just after the preceding termination, the internal pressure still remaining at a sufficient level will enable a relatively high spraying rate. If contrarily the resumption is done after lapse of a long time, the internal pressure will have already lowered to a comparatively low level. An optimal flow rate of ambient air blown towards the nozzle will not necessarily be the same for every occurrence of ignition. Thus, the controller 40 may not change the fuel feed rate to nozzle 12 but alter the number of rotations of blower 11 compelling the air to the nozzle, following the variable time intervals T" of repeated demands for ignition.

In an example, the steps 7-3, 7-13 and 7-20 for selection of duty ratio in the control mode of FIG. 7 may be replaced by alternative steps of changing the rate of blowing the air. In another example, those steps 7-3 etc. may be combined each with an additional step of changing the number of rotations of blower 11, each being done before the igniting step 7-5, 7-15 or 7-22. In detail, the air blowing rate will be changed, for example, stepwise referring to certain thresholds previously determined with respect to time lapse or spraying pressure, or simply responding to variations thereof The combustion apparatus 2 provided in each of the embodiments described above is not intended to limit the scope of the present invention but does merely exemplify a lot of feasible modes and embodiments thereof.

What is claimed is:

1. A combustion apparatus comprising:

a spraying means for spraying a fuel to be burnt and comprising a fuel spraying nozzle for jetting fuel, a fuel channel for flowing the fuel therethrough, the fuel channel comprising a fuel feed canal for communicating fuel to the fuel spraying nozzle, the fuel channel further comprising a fuel return canal for returning fuel from the fuel spraying nozzle that is communicated to the fuel spraying nozzle through the fuel feed canal and not jetted by the fuel spraying nozzle, a fuel pump disposed in the fuel channel so as to compress the fuel flowing towards the spraying means, an intermittently operating valve disposed in the return canal of the fuel channel so that a valve body of the valve is driven to close and open the return canal intermittently or periodically, and a valve controller to control the timing at which the valve body is driven to close and open the return canal.

2. The combustion apparatus as defined in claim 1, wherein the valve controller is designed to perform a duty ratio control or PWM control for the closing and opening of the valve body.

3. The combustion apparatus as defined in claim 1, wherein the valve controller is designed to control the valve body to open and close the return canal synchronously with an alternating current driving the fuel pump.

4. The combustion apparatus as defined in claim 1, wherein the valve controller is designed to control the valve body to open and close the return canal synchronously with the timings of zero-crossing signals generated in an alternating current driving the fuel pump.

5. The combustion apparatus as defined in claim 1, wherein the valve controller is designed to control the valve body to open the return canal upon detection of every zero-crossing signal that is generated in an alternating current driving the fuel pump.

6. The combustion apparatus as defined in claim 1, wherein pressure relief is executed either after or before a combustion process, by keeping open the intermittently operating valve for a given duration.

7. The combustion apparatus as defined in claim 1, wherein a pre-combustion pressure relief is executed before a combustion process, with a post-combustion pressure relief being executed after the combustion process, such that in the pre-combustion pressure relief the intermittently operating valve is kept open for a shorter time, with this valve being kept open for a longer time in the post-combustion pressure relief.

8. The combustion apparatus as defined in claim 1, wherein lapse of time is measured from a preceding termination of a combustion process until a succeeding resumption thereof, the apparatus further comprising an ignition controller for modifying the spraying rate of fuel at the beginning of a resumed combustion process and on the basis of the measured time lapse.

9. The combustion apparatus as defined in claim 1, wherein lapse of time is measured from a preceding termination of a combustion process until a succeeding resumption thereof, the apparatus further comprising an ignition controller such that the spraying rate of fuel when re-igniting it will be reduced if the measured time lapse is equal to or longer than a given reference time, than other spraying rates intended for any other time lapse shorter than this reference time.

10. The combustion apparatus as defined in claim 1, further comprising an air-blowing means for positively supplying air to be consumed in combustion of the fuel, as well as an ignition controller for modifying the spraying rate of fuel at the beginning of a resumed combustion process, and on the basis of such a measured time lapse.

11. The combustion apparatus as defined in claim 1, further comprising an ignition controller such that the spraying rate of fuel when re-igniting is reduced if a measured fuel pressure is lower than a given reference value, than other spraying rates intended for any fuel pressures equal to or higher than this reference value.

12. A combustion apparatus comprising:

a spraying means for spraying a fuel to be burnt and comprising a fuel spraying nozzle for ietting fuel, a fuel channel for flowing the fuel therethrough, the fuel channel comprising a fuel feed canal for communicating fuel to the fuel spraying nozzle, the fuel channel further comprising a fuel return canal for returning fuel from the fuel spraying nozzle that is communicated to the fuel spraying nozzle through the fuel feed canal and not jetted by the fuel spraying nozzle, a fuel pump disposed in the fuel channel so as to compress the fuel flowing towards the spraying means and, an intermittently operating valve disposed in the return canal of the fuel channel so that a valve body of the valve is driven to close and open the return canal intermittently or periodically at regular and variable intervals by a duty-ratio control, wherein the duty-ratio control is repeated at a frequency that is adjusted responsive to a required amount of heat to be generated.

13. The combustion apparatus as defined in claim 12, wherein the duty-ratio control involves a plurality of hypothetical regions that have different frequencies of the duty-ratio control in relation to the required amount of heat to be generated per unit time.

14. The combustion apparatus as defined in claim 12, further comprising a valve controller for controlling the intermittently operating valve with action relying on a plurality of electronics reference tables each being an array of valve-operating data, such that the frequencies of the duty-ratio control differ from each other between the tables, and one of them is selected to match a desired flow rate of the fuel being sprayed and burnt.

15. The combustion apparatus as defined in claim 12, wherein the one cycle time in the duty-ratio control is prolonged for comparatively lower amount of heat required to be generated per unit time.

16. A combustion apparatus comprising:

a spraying means for spraying a fuel, a fuel channel for flowing the fuel therethrough, a fuel pump disposed in the fuel channel so as to compress the fuel flowing towards the spraying means, and an intermittently operating valve disposed in the fuel channel so that a valve body of this valve close and open the channel periodically at regular and variable intervals by the duty-ratio control, the valve body fully closing the channel when it is at a first position, the valve body fully opening the channel when it is at a second position, wherein the duty-ratio control is repeated at a frequency that is adjusted responsive to the current flow rate of the fuel being burnt, in such a manner that if the ratio of a first time length for the valve body to move once from the first position to the second position and then back from the second position to the first position divided by a second time length in which said valve body remains at the second position during one cycle of said duty-ratio control does exceed a threshold, then one cycle time in the duty-ratio control is prolonged.

17. The combustion apparatus as defined in claim 16, wherein the duty-ratio control is conducted in such a manner that if the duty ratio for causing the intermittently operating valve to open does exceed a reference value, one cycle time in the duty-ratio control is prolonged.

18. The combustion apparatus as defined in claim 16, wherein the valve controller is designed to drive the valve body synchronously with the timings of zero-crossing signals generated in an alternating current driving the fuel pump.

19. A combustion apparatus comprising:

a spraying means for spraying a fuel, a fuel channel for flowing the fuel therethrough, a fuel pump disposed in the fuel channel so as to compress the fuel flowing towards the spraying means, an intermittently operating valve disposed in the fuel channel so that the valve is closed and opened periodically at regular and variable intervals by a duty-ratio control, and a temperature sensing means also disposed in the fuel channel in order to detect the temperature of fuel flowing through the fuel channel, wherein the intermittently operating valve is driven at a frequency that is adjusted based on the temperature detected by the sensing means during combustion.

20. The combustion apparatus as defined in claim 19, wherein the frequency of electric current for driving the intermittently operating valve is lowered if and when the temperature detected by the sensing means is above a reference temperature.

* * * * *